US007516601B2

(12) United States Patent
Horiuchi

(10) Patent No.: US 7,516,601 B2
(45) Date of Patent: Apr. 14, 2009

(54) SHEET PROCESSING SYSTEM

(75) Inventor: Haruhiko Horiuchi, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 12/057,702

(22) Filed: Mar. 28, 2008

(65) Prior Publication Data

US 2008/0236101 A1 Oct. 2, 2008

(30) Foreign Application Priority Data

Mar. 30, 2007 (JP) ..... 2007-094920

(51) Int. Cl.
*B65B 11/00* (2006.01)
*B65B 53/02* (2006.01)

(52) U.S. Cl. ..... 53/582; 53/540; 53/544; 53/591

(58) Field of Classification Search ..... 53/537, 53/540, 544, 582, 591, 557, 447, 442, 399
See application file for complete search history.

(56) References Cited

U.S. PATENT DOCUMENTS 4,845,917 A * 7/1989 Omura et al. ..... 53/53
5,012,932 A * 5/1991 Omura et al. ..... 53/53
5,022,531 A * 6/1991 Horino et al. ..... 53/53
5,931,634 A * 8/1999 Neri ..... 414/790
6,070,398 A * 6/2000 Neri ..... 53/582
6,135,703 A * 10/2000 Neri ..... 414/791.2
6,385,948 B1 * 5/2002 Schneider et al. ..... 53/540
6,453,645 B1 * 9/2002 Suokas et al. ..... 53/544
6,550,221 B1 * 4/2003 Neri ..... 53/540
6,584,754 B1 * 7/2003 Neri ..... 53/540
6,619,014 B2 * 9/2003 Muller ..... 53/540

FOREIGN PATENT DOCUMENTS

JP 09-110011 4/1997
JP 10-143710 5/1998

* cited by examiner

*Primary Examiner*—Louis K Huynh
(74) *Attorney, Agent, or Firm*—Pillsbury Winthrop Shaw Pittman, LLP

(57) ABSTRACT

A sheet processing system includes a banding machine which uses a large band to bundle first collected bundles fed out by a bundle collecting device and then feeds out the bundled first collected bundles as a first bunch of sealed five bundles, the a banding machine then using the large band to bundle again second collected bundles fed out by the bundle collecting device and then feeding out the bundled second collected bundles as a second bunch of sealed five bundles, and a bundle handling device which lays the first and second bunches of sealed five bundles fed out by the banding machine on top of each other so that small bands around the first and second bunches are staggered, the bundle handling device then feeding out the first and second bunches laid on top of each other.

9 Claims, 27 Drawing Sheets

SHEET PROCESSING SYSTEM

CROSS-REFERENCE TO RELATED APPLICATIONS

This application is based upon and claims the benefit of priority from prior Japanese Patent Application No. 2007-094920, filed Mar. 30, 2007, the entire contents of which are incorporated herein by reference.

BACKGROUND OF THE INVENTION

1. Field of the Invention

The present invention relates to, for example, a sheet processing system that packs a bunch of sheets such as securities.

2. Description of the Related Art

A sheet processing system processing sheets such as securities is composed of a sheet processor that processes the sheets, a conveyor that conveys a bundle discharged by the sheet processor, and a packing device that packs a predetermined number of bundles conveyed by the conveyor.

The sheet processor takes out and conveys collectively supplied sheets one by one. A determination section determines whether each of the sheets is true or false and whether the sheet is normal or damaged. On the basis of the determinations, the sheet processor sorts and collects the sheets. When the number of the collected sheets reaches, for example, 100, the sheets are passed to a bundling section, which then bundles the sheets using a small band to form a bundle. The bundle thus formed is discharged by the sheet processor and fed to the conveyor, on which the bundle is conveyed. Ten bundles are further collectively bundled together using a large band to form a bunch (see, for example, Jpn. Pat. Appln. KOKAI Publication No. 10-143710).

The bundle formed using the small band is slightly wider at the opposite ends. Since the position of the small band is normally away from a longitudinally central part of the sheets, the width of the bundle at one end is different from the width of the bundle at the other end.

However, in packing a predetermined number of bundles together, the sheet processor described in Jpn. Pat. Appln. KOKAI Publication No. 10-143710 bundles every 10 bundles with all the small bands around the bundles aligned with one another in the same direction. This may disadvantageously result in a nonuniform thickness and thus prevent the bundles from being packed so as to have an appropriate shape.

BRIEF SUMMARY OF THE INVENTION

An aspect of the present invention has been made by focusing on the above-described circumstances. An object of the present invention is to provide a sheet processing system which enables a predetermined number of bundles to be bundled so as to have a uniform thickness and which enables the predetermined number of bundles to be bundled so that the bundles face in the same direction, the system, when transferring a bunch to a packing device, allowing the bunch to be positioned such that the center of the bunch aligns with the center of the packing device.

To attain this object, an aspect of the present invention provides a sheet processing system comprising a sheet processor which takes out and conveys sheets one by one from a supply section to which the sheets are collectively supplied, the sheet processor determining whether each of the sheets is real or false and whether the sheet is normal or damaged, executing a sorting process on the sheet on the basis of the determination, and every time the number of sheets subjected to the sorting process reaches a predetermined value, bundling the sheets using a first bundling band to form a bundle and then discharging the bundle, a bundle collecting device which collects a predetermined number of bundles discharged by the sheet processor and feeds out the bundles as first collected bundles and which then collects again a predetermined number of bundles discharged by the sheet processor and feeds out the bundles as second collected bundles, a bunch processor comprising a bunch forming device which uses a second bundling band different from the first bundling band to bundle the first colleted bundles fed out by the bundle collecting device and feeds out the bundled bundles as a first bunch, the bunch forming device then using the second bundling band different from the first bundling band to bundle the second colleted bundles fed out by the bundle collecting device and feeds out the bundled bundles as a second bunch, and a bunch laying device which lays the first and second bunches fed out by the bunch forming device, on top of each other so that the first bundling bands around the bunches are staggered and feeds out the bunches laid on top of each other, a conveying device which receives and conveys the first and second bunches fed out by the bunch processor, on a conveying path, a transfer device which receives the first and second bunches conveyed by the conveying device and transfers and feeds out the first and second bunches to a predetermined position, and a packing device which packs the first and second bunches fed out by the transfer device.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

An embodiment of the present embodiment will be described below in detail with reference to the drawings.

Figure 1:
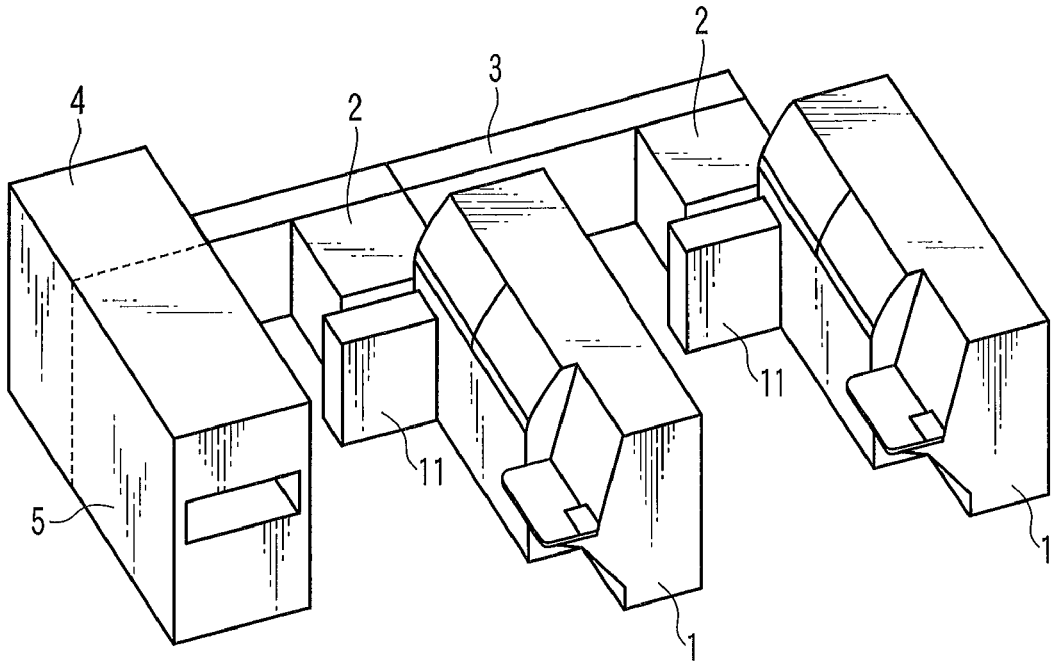
FIG. 1 is a perspective view showing a sheet processing system that is an embodiment of the present invention.

FIG. 1 is a schematic diagram showing the configuration of a sheet processing system that is an embodiment of the present invention.

The sheet processing system is composed of a sheet processor 1, a bundle collecting device 11, a bundle handling device 2 as a bundle processor, a conveyor 3 as a conveying device, a lifter device 4 as a transfer device, and a packing device 5.

In the sheet processing system, increasing the conveying length of the conveyor 3 enables the installation of plural sets of the sheet processor 1, the bundle collecting device 11, and the bundle handling device 2. However, for simplification, in the present embodiment, two sets are connected together.

Figure 2:
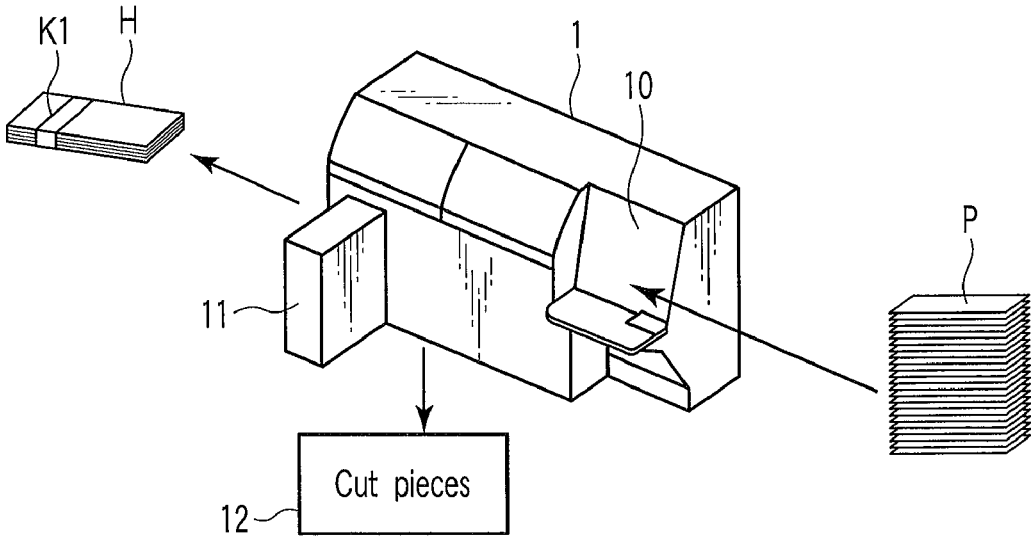
FIG. 2 is a perspective view showing a sheet processor in FIG. 1.

The sheet processor 1 comprises a supply section 10 to which sheets are collectively supplied as shown in FIG. 2, and takes out and conveys the sheets supplied to the supply section 10, one by one. In the middle of a conveying path, a sheet determining device (not shown) determines whether the sheet being conveyed is real or false and whether the sheet is normal or damaged (whether or not the sheet is reusable). On the basis of the determinations, the sheet is subjected to sorting, and if the sheet is normal, the sheet is placed in a collecting device (not shown). If the sheet is damaged, the sheet is cut into pieces 12 by a cutting device (not shown) built in the sheet processor 1, with the pieces 12 discharged.

Every time the number of collected sheets reaches a predetermined value (for example, 100), the collecting device (not shown) feeds the sheets to a bundling device (not shown). The bundling device uses a paper band (hereinafter referred to as a small band) K1 that is a first bundling band to bundle the sheets at a position located away from a longitudinally central part of the sheets, to form a bundle H. The bundle H formed is fed to the bundle collecting device 11, in which bundles are collected. When a determined number of (for example, five) bundles H are collected in the bundle collecting device 11, the collected bundles are fed to the bundle handling device 2.

The bundle handling device 2 uses a plastic film (large band) that is a second bundling band to bundle the collected bundles (five bundles) fed by the bundle collecting device 11, to form a bunch (hereinafter referred to as a bunch of sealed five bundles).

The bundle handling device 2 thus sequentially forms and feeds out bunches of sealed five bundles. The bundle handling device 2 alternately combines a bunch of sealed five bundles (first bunch of sealed five bundles) and a succeeding bunch of sealed five bundles and supplies the 10 bundles to the conveyor 3. The thus supplied 10 bundles are supplied to the packing device 5 via the lifter device 4.

Figure 3:
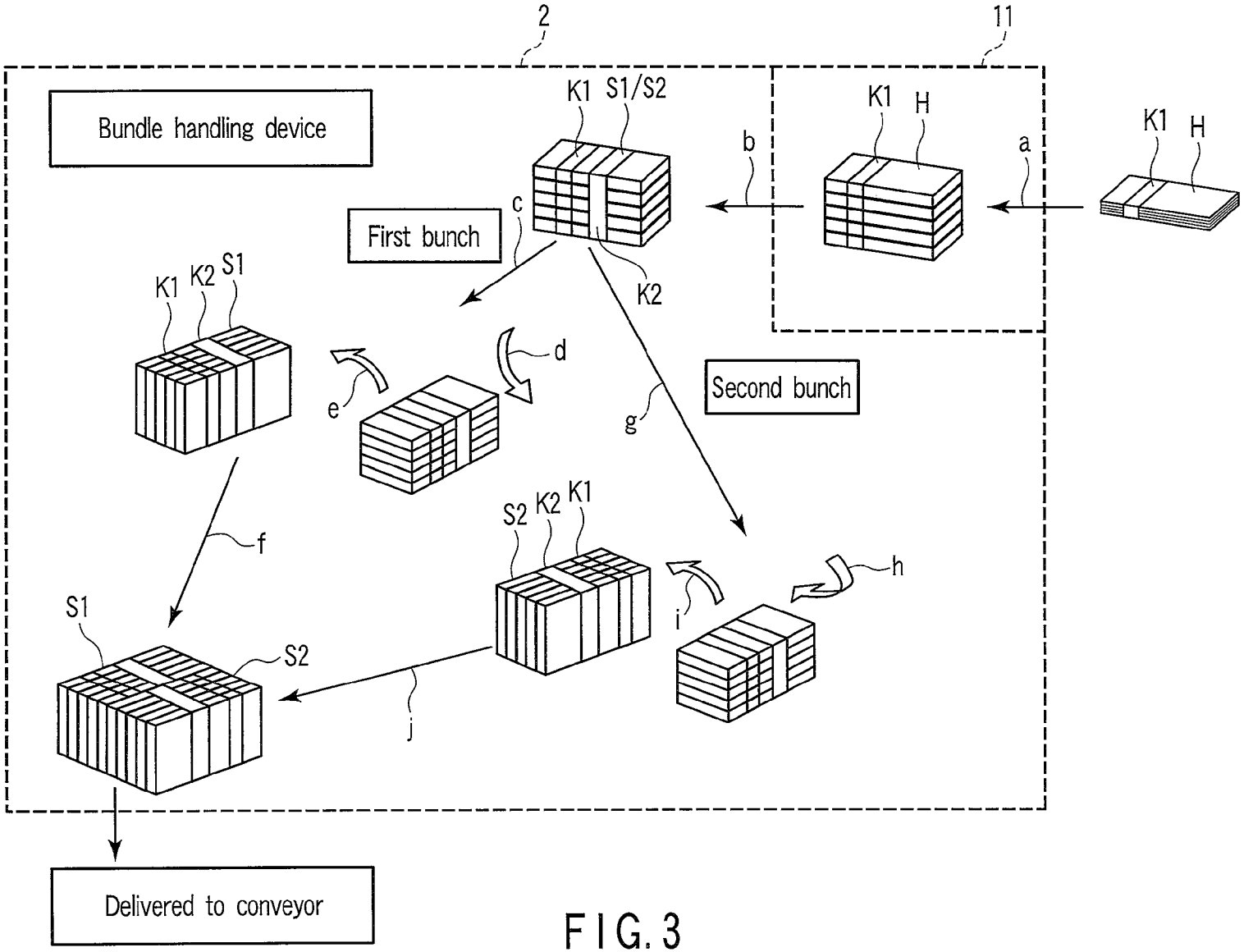
FIG. 3 is a diagram showing the flow of bundles in a bundle handling device in FIG. 1.

FIG. 3 is a schematic diagram showing a flow in which the bundle handling device 2 forms the bundles H discharged by the sheet processor 1 into a first bunch of sealed five bundles S1 and a second bunch of sealed five bundles S2 and lays the first and second bunches on top of each other.

The bundles H formed by the sheet processor 1 are fed to the bundle collecting device 11 as shown by arrow a. Once a predetermined number of (for example, five) bundles have been collected, the bundles are fed to a bundling section of the bundle handling device 2 as shown by arrow b. The bundles are then bundled using the large bundle K2 that is a plastic film so as to form the first bunch of sealed five bundles S1. A turn section described below in detail then rotates the first bunch of sealed five bundles S1 counterclockwise through 90° (predetermined angle) as shown by arrow d. The first bunch of sealed five bundles S1 is then rotated through 90° (predetermined angle) as shown by arrow e so as to stand upright in such a manner that a side surface of the first bunch is placed at a bottom position. Then, the upright first bunch of sealed five bundles S1 is fed out as shown by arrow f and placed on a chuter described below.

Subsequently, the succeeding bundle H fed out by the sheet processor 1 is fed to the bundle collecting device for collection. Once a predetermined number of (for example, five) bundles have been collected, the bundles are fed to the bundling section of the bundle handling device 2 as shown by arrow b. The bundles are bundled using the large band K2 so as to form a second bunch of sealed five bundles S2. The second bunch of sealed five bundles S2 is fed, as shown by arrow g, to the turn section, described below in detail. The turn section then rotates the second bunch of sealed five bundles S2 counterclockwise through 90° (predetermined angle). The second bunch of sealed five bundles S2 is then rotated through 90° (predetermined angle) as shown by arrow i so as to stand upright in such a manner that a side surface of the second bunch is placed at a bottom position. Then, the upright second bunch of sealed five bundles S2 is fed out as shown by arrow j and placed on a chuter described below.

The first and second bunches of sealed five bundles S1 and S2 are placed such that the small bands K1 are staggered and such that the bundles face in the same direction.

Figure 4:
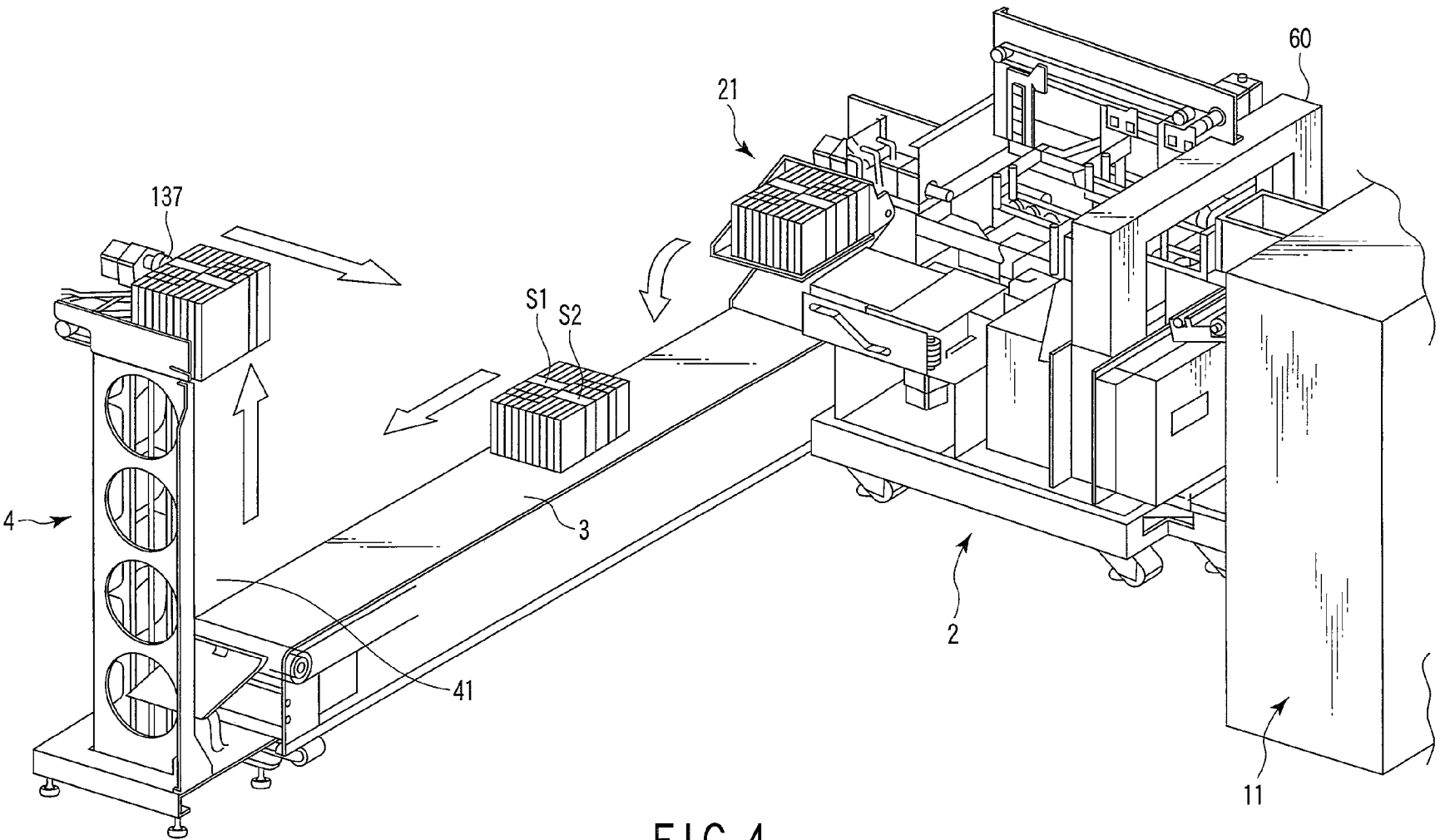
FIG. 4 is a diagram showing the flow of two bunches of sealed five bundles in the sheet processing system in FIG. 1.

FIG. 4 is a perspective view showing the bundle handling device 2, the conveyor 3, and the lifter device 4, all described above.

The bundle handling device 2 comprises the chuter 21. A bunch control device 23 adjusts a timing at which the two bunches of sealed five bundles S1 and S2 placed on a tray 22 in the chuter 21 are supplied to the conveyor 3. The two bunches of sealed five bundles S1 and S2 supplied to the conveyor 3 are lifted by the lifter device 4 and pushed out toward the packing device 5 by a pusher 137.

Figure 5:
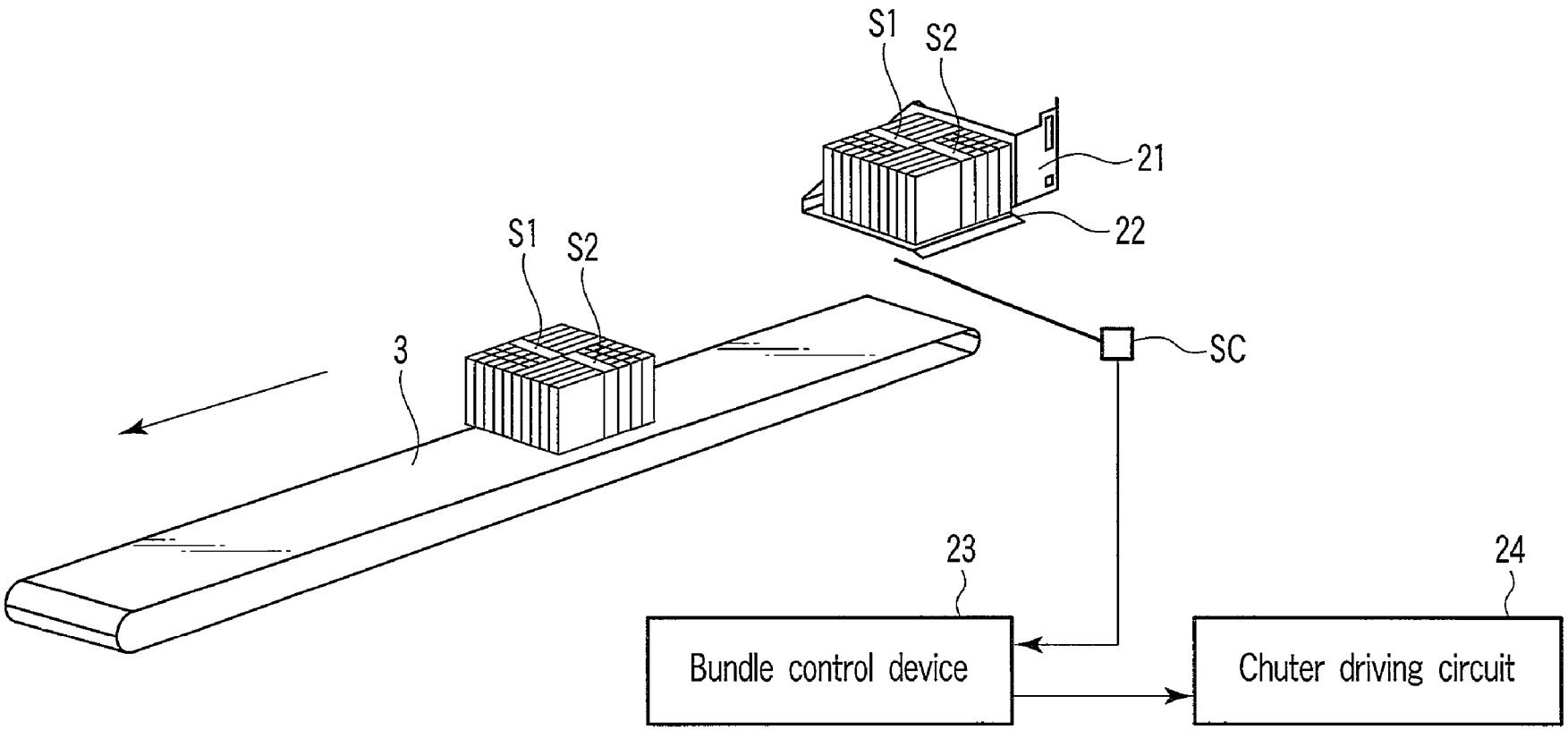
FIG. 5 is a diagram showing a driving control system for a chuter in FIG. 1.

FIG. 5 is a perspective view showing a control system for the chuter 21.

A bunch sensor SC is provided upstream of the chuter 21 in a bunch conveying direction. The bunch control device 23 is connected to the bunch sensor SC via a sensing circuit. A chuter driving circuit 24 is connected to the bunch control device 23 via a control circuit.

Figure 6A:
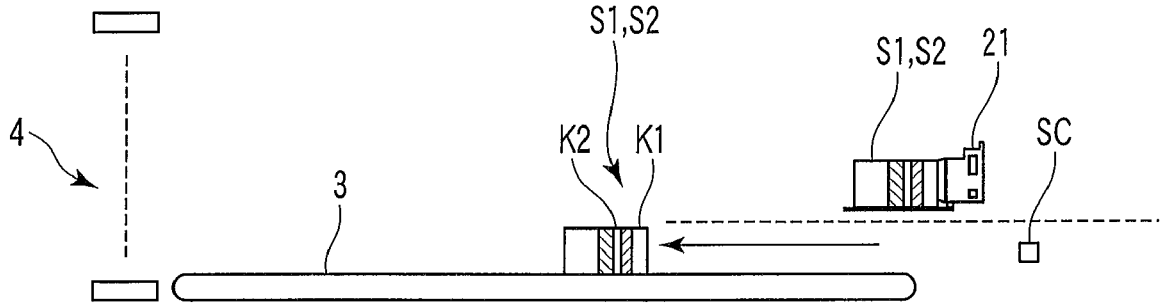
FIG. 6A is a diagram showing the operation of the chuter in FIG. 5.
Figure 6B:
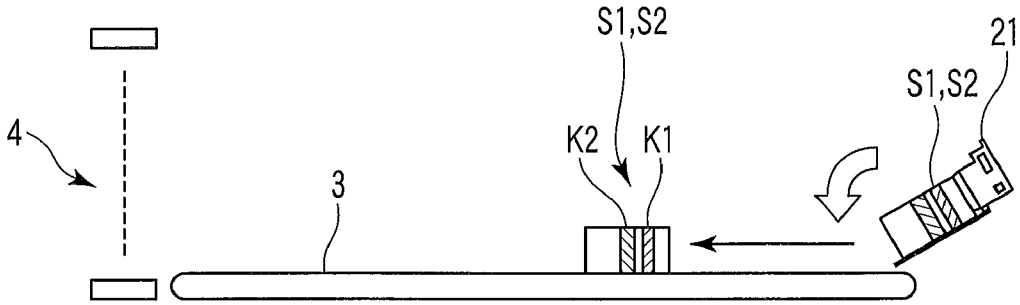
FIG. 6B is a diagram showing the operation of the chuter in FIG. 5.
Figure 6C:
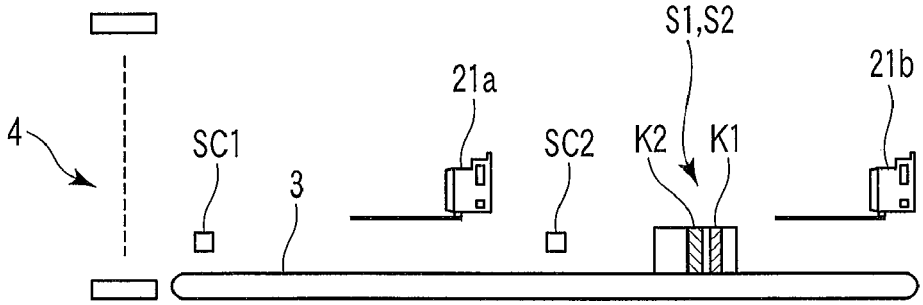
FIG. 6C is a diagram showing the operation of the chuter in FIG. 5.

FIGS. 6A to 6C are diagrams illustrating the operation of the chuter 21.

As shown in FIG. 4, the two bunches of sealed five bundles S1 and S2 bundled by the bundle handling device 2 so as to face in the direction different from the regular one are placed on the tray 22 in the chuter 21 and stand by.

The above-described aspect is used for the following reasons. The thickness of sheets is not uniform owing to the print state of the sheets. Thus, the above-described sheets are arranged so as to face in the direction different from the regular one in order to make uniform the thickness of the 10 bundles laid on top of one another. Furthermore, the position at which the small band K1 is placed around the bundles for bundling is varied for every five bundles in order to facilitate measurement of the position.

If a plurality of the sheet processors 1 are installed as in the present embodiment, the bundles H processed by the sheet processors 1 are randomly discharged. The discharged bundles H are aligned with one another by the bundle handling device 2 and then stand by on the chuter 21. The above-described bundle handling device 2 and chuter 21 are independently arranged on each of the sheet processors 1 to deliver the bundles H to the conveyor 3.

The above-described chuters 21 are all configured in the same manner. Thus, one of the chuters 21 will be described.

The bunch control device 23 performs monitoring using the bunch sensor SC, placed upstream of the chuter in the conveying direction, to sense a medium on the conveyor 3. When a predetermined number of (two) bunches of sealed five bundles S1 and S2 are present on the tray 22 in the chuter 21 and the bunch sensor SC is bright (no bunch of sealed five bundles is sensed), the corresponding signal is communicated to the chuter driving circuit 24. On the basis of the signal, the chuter driving circuit 24 pivots the chuter 21 to discharge the bunches of sealed five bundles S1 and S2 on the tray 22, onto the conveyor 3.

FIG. 6A shows that since the bunch sensor SC is dark (bunches of sealed five bundles have been sensed), the bunch control device is waiting for the two bunches of sealed five bundles S1 and S2 to pass through.

FIG. 6B shows that the time set for the passage waiting operation shown in FIG. 6A has elapsed and that the bunches of sealed five bundles are being discharged onto the conveyor 3.

FIG. 6C shows control performed when the two bunches of sealed five bundles S1 and S2 are discharged by two sets each of the sheet processor 1, the bundle handling device 2, and the chuter 21.

The bunches of sealed five bundles S1 and S2 discharged by chuters 21*a* and 21*b* are conveyed by the conveyor 3. The state of the conveyance is monitored by sensors SC1 and SC2. If the bunches of sealed five bundles S1 and S2 are not present on the conveyor 3, one of the bunches of sealed five bundles S1 and S2 in the chuters 21*a* and 21*b* which is ready for discharge is first discharged. If the bunches of sealed five bundles S1 and S2 simultaneously become ready for discharge, one of the bunches sensed by the monitoring sensor 21*a*, located closer to the lifter device 4, is first discharged.

The thus discharged bunches of sealed five bundles S1 and S2 are delivered from the conveyor 3 to the lifter device 4. During the delivery, if the lifter device 4 is processing the bunches of sealed five bundles S1 and S2, the conveyor 3 is stopped on the basis of sensing of the bunches of sealed five bundles S1 and S2 by the sensor SC1.

As a result, when the lifter device 4 are ready to receive the bunches, the conveyor 3 is driven again to continue processing the bunches of sealed five bundles sensed by the sensor SC1.

For the process of delivery to the lifter device 4, similar results can be achieved by, for example, the following method. That is, the bunches of sealed five bundles in the chuter 21 are caused to stand by until the lifter device 4 becomes ready. When the lifter device 4 is ready, the conveyor 3 is driven again.

Figure 7A:
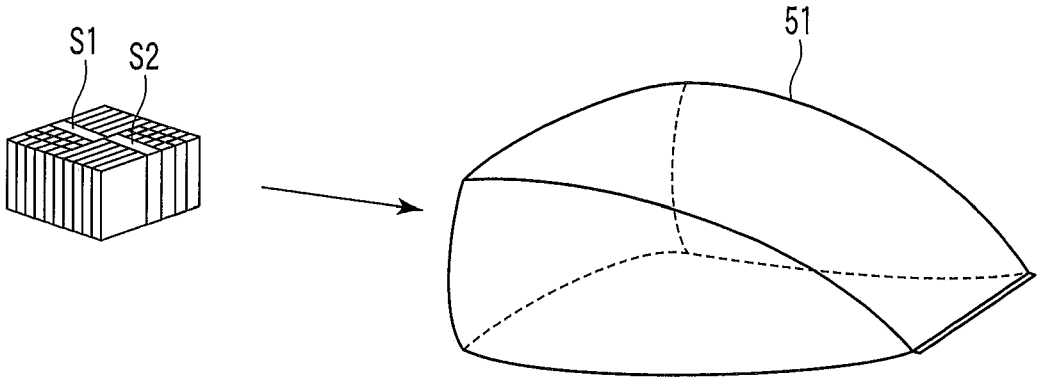
FIG. 7A is a diagram showing how the two bunches of sealed five bundles are transferred from a lifer device to a packing device for packing.
Figure 7B:
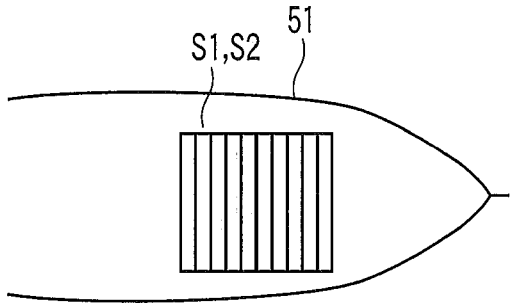
FIG. 7B is a diagram showing how the two bunches of sealed five bundles are transferred from the lifer device to the packing device for packing.

FIGS. 7A and 7B are schematic diagrams illustrating how the packing device 5, shown in FIG. 1 packs the two bunches of sealed five bundles S1 and S2.

FIG. 7A shows a state immediately before the two bunches of sealed five bundles S1 and S2 lifted by the lifter device 4 and supplied to the packing device 5 by the pusher 137 are packed.

FIG. 7B is a diagram showing how the two bunches of sealed five bundles S1 and S2 are inserted into a tunnel-like shrink film 51.

Figure 8:
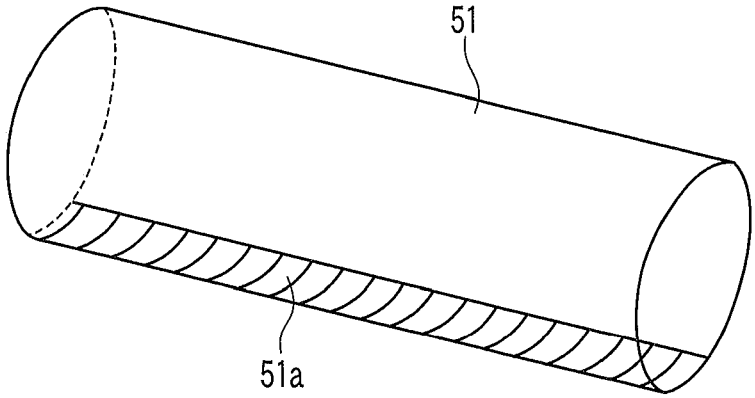
FIG. 8 is a perspective view showing a shrink film in FIG. 7.

FIG. 8 is a diagram showing the form of the tunnel-like shrink film 51, shown in FIG. 7A.

The tunnel-like shrink film 51 is formed by rolling a film like a cylinder, thermally bonding an overlapping portion 51*a*, and further thermally compression-bonding a tip portion of the cylinder. The two bunches of sealed five bundles S1 and S2 are inserted into the tunnel-like shrink film 51 with the tip portion closed. FIG. 7B shows that the bunches have been inserted into the shrink film.

Figure 9:
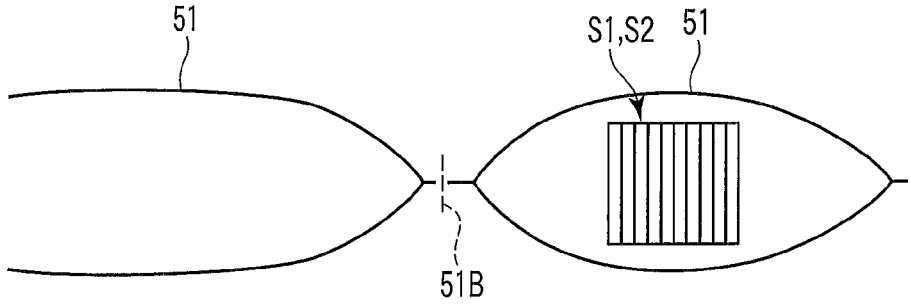
FIG. 9 is a diagram showing that the two bunches of sealed five bundles have been inserted into the shrink film.

FIG. 9 shows that the two bunches of sealed five bundles S1 and S2 inserted into the tunnel-like shrink film, shown in FIG. 8, are sealed at inlets so as to form a bag. This heat sealing forms a tunnel state in which the tip portion 51B of the succeeding tunnel-like shrink film 51 is closed. Furthermore, the shrink film 51 is cut at the tip portion 51B to separate the bagged portion from the tunnel-like shrink 51 portion.

Figures 10A, 10B, 10C:
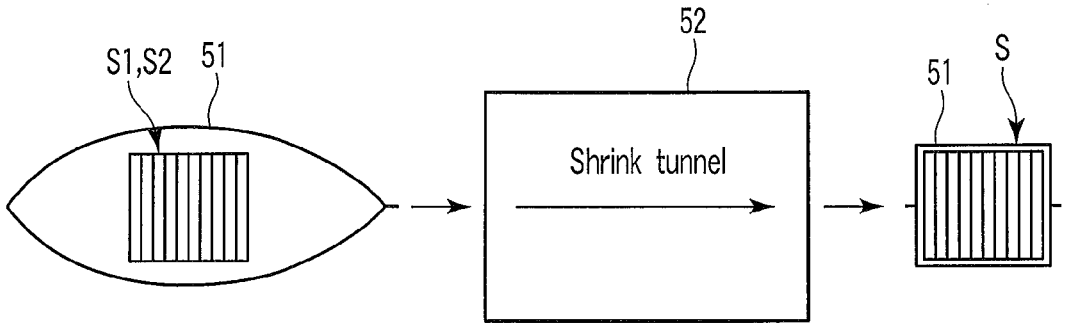
FIG. 10A is a diagram showing how the shrink film in FIG. 9 is thermally shrunk.
FIG. 10B is a diagram showing how the shrink film in FIG. 9 is thermally shrunk.
FIG. 10C is a diagram showing how the shrink film in FIG. 9 is thermally shrunk.

FIGS. 10A to 10C are diagrams illustrating the effects of the shrink tunnel.

These figures show that the two bunches of sealed five bundles S1 and S2 bagged in the tunnel-like shrink film 51 pass through a shrink tunnel 52 for packing.

FIG. 10A is a diagram showing a state observed before the two bunches of sealed five bundles S1 and S2 bagged in the tunnel-like shrink film 51 pass through the shrink tunnel 52.

FIG. 10B is a diagram that the two bunches of sealed five bundles S1 and S2 bagged in the tunnel-like shrink film 51 are passing through the shrink tunnel 52. The shrink tunnel 52 heats the two bunches of sealed five bundles S1 and S2 bagged in the shrink film 51. This heating thermally shrinks the tunnel-like shrink film 51.

FIG. 10C is a state diagram of the two bunches of sealed five bundles S1 and S2 bagged in the shrink film 51 and having passed through the shrink tunnel 52. The tunnel-like shrink film 51 is thermally shrunk by the heating to pack the two bunches of sealed five bundles S1 and S2 so that the two bunches overlap.

Now, the above-described bundle handling device 2 will be described below in further detail.

Figure 11:
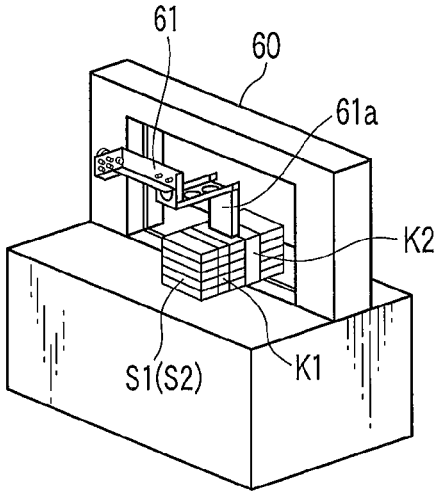
FIG. 11 is a perspective view showing a banding machine in the bundle handling device in FIG. 3.

FIG. 11 shows a banding machine 60 as a bunch forming device which places the large band K2 around the (five) collected bundles fed out by the bundle collecting device 11. A transfer arm 61 is provided in the vicinity of the banding machine 60 to transfer the bunch of sealed five bundles S1 (S2) bundled by the banding machine 60. The transfer arm 61 stands by at a standby position when the banding machine 60 performs a banding operation. When located at the standby position, the transfer arm 61 does not interfere with the banding operation of the banding machine 60.

The transfer arm 61 has a folded piece 61*a* formed by folding the transfer arm 61 downward in a vertical direction. The transfer arm 61 is moved by a driving mechanism (not shown) to transfer the bunch of sealed five bundles S1 (S2) from the banding machine 60 to a rotating tray 66 in a direction changing mechanism 64 which corresponds to the next step.

Figure 12:
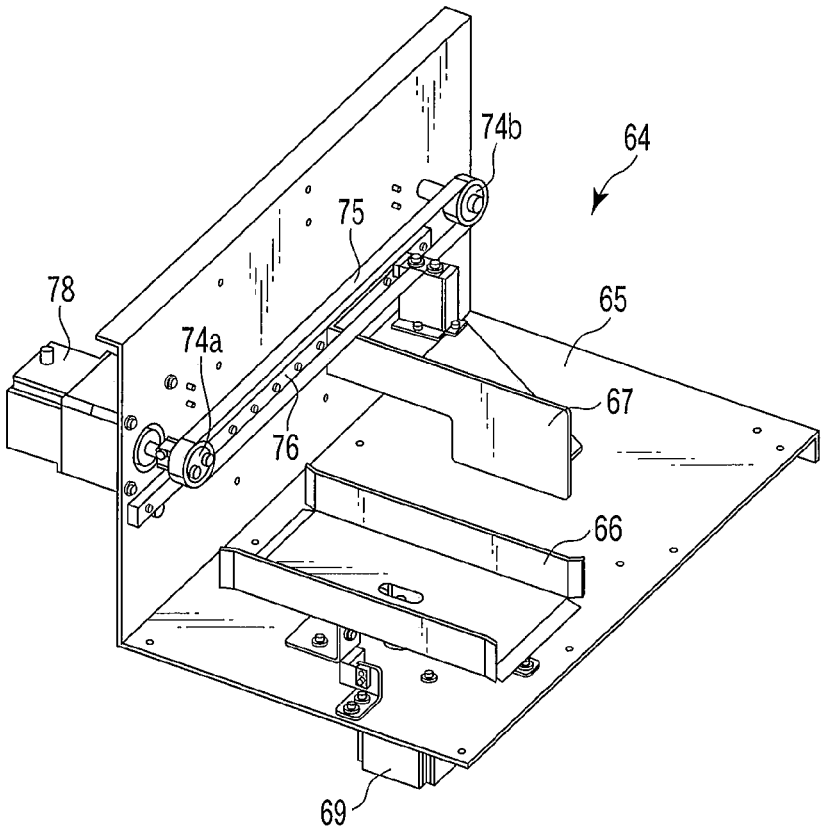
FIG. 12 is a perspective view showing a direction changing mechanism in the bundle handling device in FIG. 3.
Figure 13:
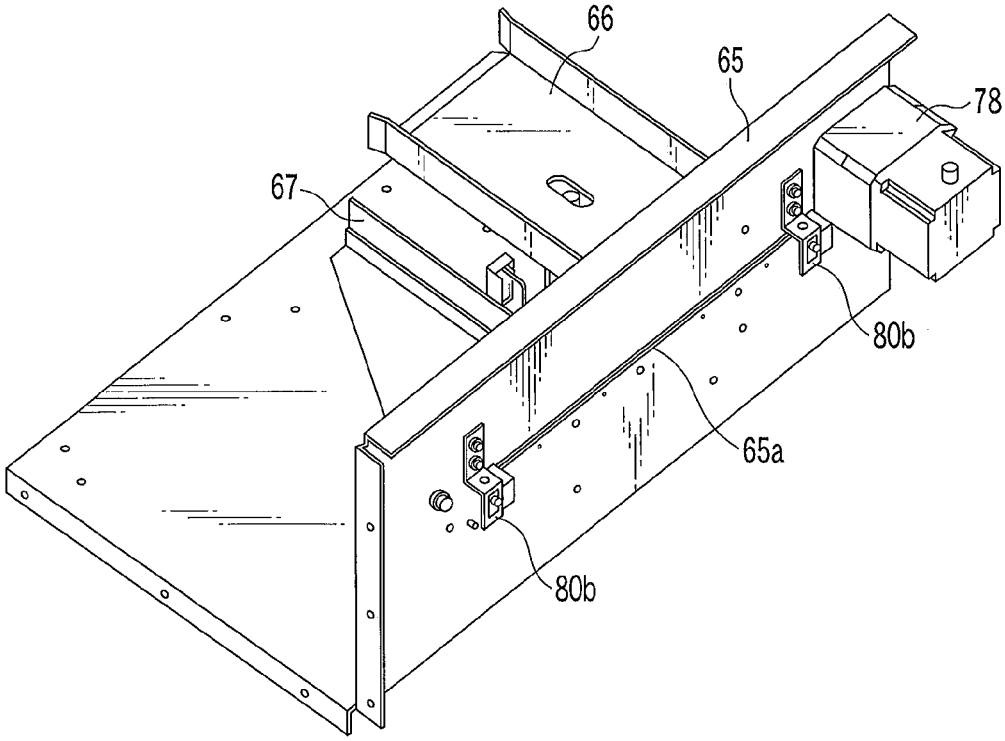
FIG. 13 is a perspective view showing the direction changing mechanism in FIG. 12 as viewed from a different direction.

FIG. 12 is a perspective view of the direction changing mechanism 64, which receives the bunch of sealed five bundles transferred by the transfer arm 61, changes the direction of the bunch of sealed five bundles by 90°, and then feeds out the bunch. FIG. 13 is a perspective view of the direction changing mechanism as viewed from a different direction.

Figure 14:
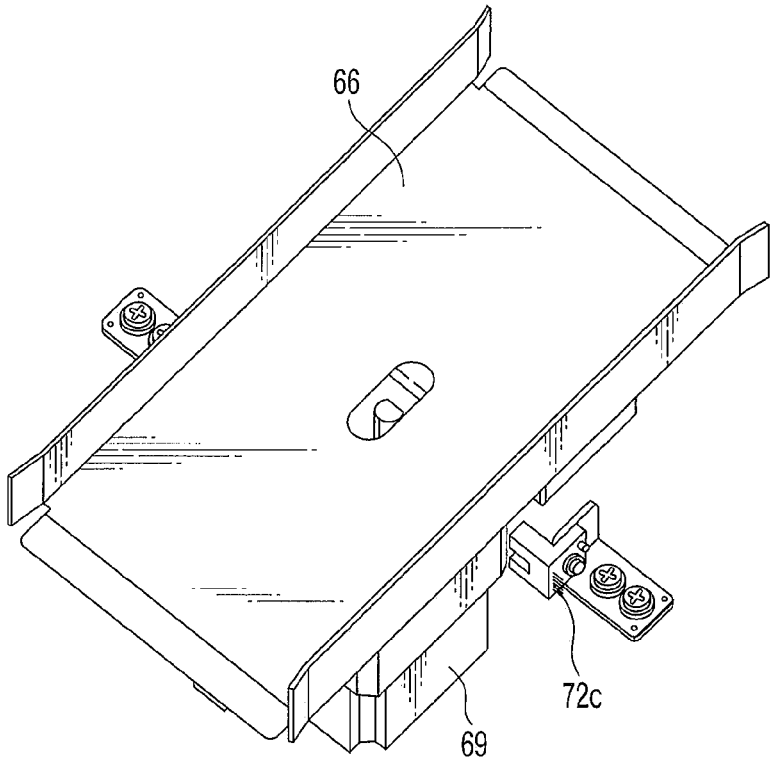
FIG. 14 is a perspective view showing a rotating tray in FIG. 12.
Figure 15:
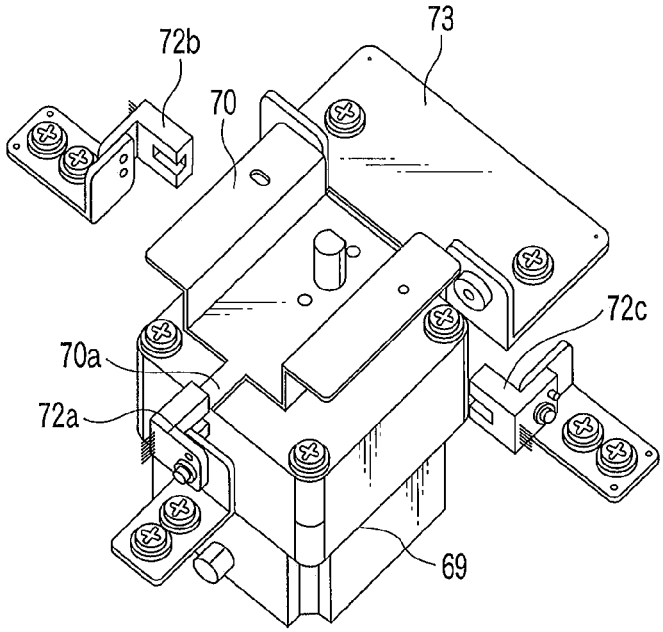
FIG. 15 is a perspective view showing a driving motor that rotates the rotating tray in FIG. 14.

The direction changing mechanism 64 comprises a support frame 65 formed to have an L-shaped cross section. The support frame 65 has the rotating tray 66 and a pusher 67 as a feed-out device both disposed on a horizontal plane portion; the rotating tray 66 receives the transferred bunch of sealed five bundles, and the pusher 67 feeds out the bunch of sealed five bundles received on the rotating tray 66. A driving motor 69 is provided on an underside of the horizontal plane portion of the support frame 65 to rotate the rotating tray 66 forward and backward as shown in FIGS. 14 and 15. The rotating tray 66 is connected to the driving motor 69 via a mounting bracket 70. A first position sensor 72*a* to a third position sensor 72*c* are disposed on a peripheral portion of the driving motor 69 to sense the position of a sensor dog 70*a* on the mounting bracket 70. The position sensor 72*a* senses the position of the sensor dog 70*a* when the rotating tray 66 has rotated to the position where the rotating tray 66 receives the bunch of sealed five bundles. The position sensor 72*b* senses the position of the sensor dog 70*a* when the rotating tray 66 has rotated clockwise through 90°. The position sensor 72*c* senses the position of the sensor dog 70*a* when the rotating tray 66 has rotated counterclockwise through 90°. On the basis of the sensing of the sensor dog 70*a* by the position sensors 72*a* to 72*c*, the driving motor 69 stops the driving operation and thus the rotation of the rotating tray 66. A stopper 73 is installed in the vicinity of the position sensors 72*b* and 72*c* to regulate the rotation of the dog 70*a* on the rotating tray 66 beyond the position sensors 72*b* and 72*c*.

A driving pulley 74*a* and a driven pulley 74*b* are disposed on a vertical plane portion of the support frame 65 as shown in FIG. 12. A driving belt 75 is placed between the driving pulley 74*a* and the driven pulley 74*b*. A slide rail 76 is provided on the vertical plane portion of the support frame 65 parallel to the driving belt 75. A rear end of the pusher 67 is coupled to the driving belt 75. The pusher 67 is reciprocated along the slide rail 76 by means of rotation of the driving belt 75.

A driving motor 78 is provided on a back surface of the vertical plane portion of the support frame 65 to rotate the driving pulley 74*a* forward and backward. A slot 65*a* is formed on the vertical plane portion of the support frame 65 along the direction in which the pusher 67 moves. Position sensors 80*a* and 80*b* are disposed at respective ends of the slot 65*a*. The position sensor 80*a* senses the position of the pusher 67 when the pusher 67 has moved to the standby position. The position sensor 80*b* senses the position of the pusher 67 when the pusher 67 has fed out the bunch of sealed five bundles. On the basis of the sensing of the position of the pusher 67 by the position sensors 80*a* and 80*b*, the driving motor 78 stops the driving operation and thus the movement of the pusher 67.

Figure 16:
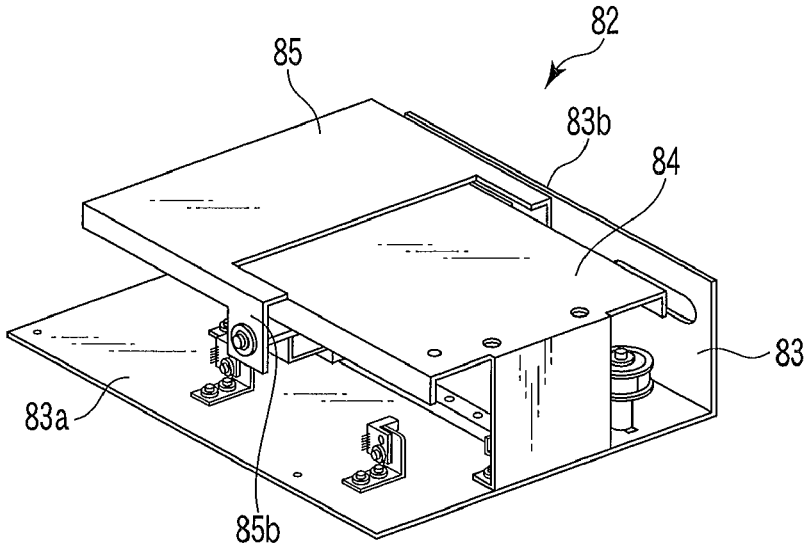
FIG. 16 is a perspective view showing a standing mechanism in the bundle handling device in FIG. 3.
Figure 17:
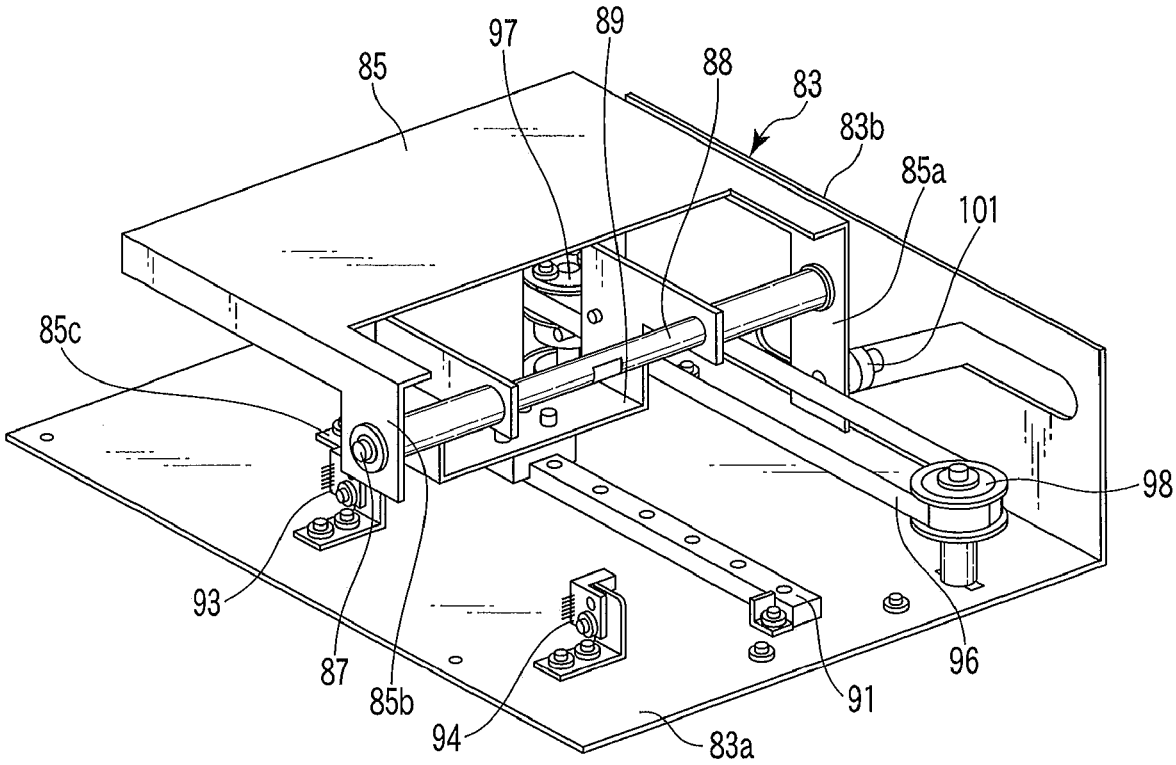
FIG. 17 is a perspective view showing a driving system for the standing tray in FIG. 16.

FIG. 16 is a perspective view showing a standing mechanism 82 as bunch laying device which receives the bunch of sealed five bundles fed out by the pusher 67 and which rotates the bunch through 90° so as to stand the bunch upright. The standing mechanism 82 comprises a support frame 83 made up of a board 83*a* and a folded portion 83*b* formed on one side of the board 83*a* by folding the board 83*a* in the vertical direction. A table 84 and a standing tray 85 as a standing device are disposed on the board 83*a* of the support frame 83. The standing tray 85 has a pair of leg portions 85*a* and 85*b* formed at respective ends of one side as also shown in FIG. 17. A shaft 88 is mounted between the leg portions 85*a* and 85*b* via a bearing 87 and held by a holding bracket 89.

A slide rail 91 and position sensors 93 and 94 are disposed on the board 83*a* of the support frame 83; the slide rail 91 guides movement of the holding bracket 98, and the position sensors 93 and 94 are positioned at respective ends of the slide rail 91 to detect the position of a sensor dog 85*c* of the standing tray 85. On the basis of the sensing of the position of the sensor dog 85*c* on the standing tray 85 by the position sensors 93 and 94, a driving motor 100 described below stops a driving operation and thus the movement of the standing tray 85.

Figure 18:
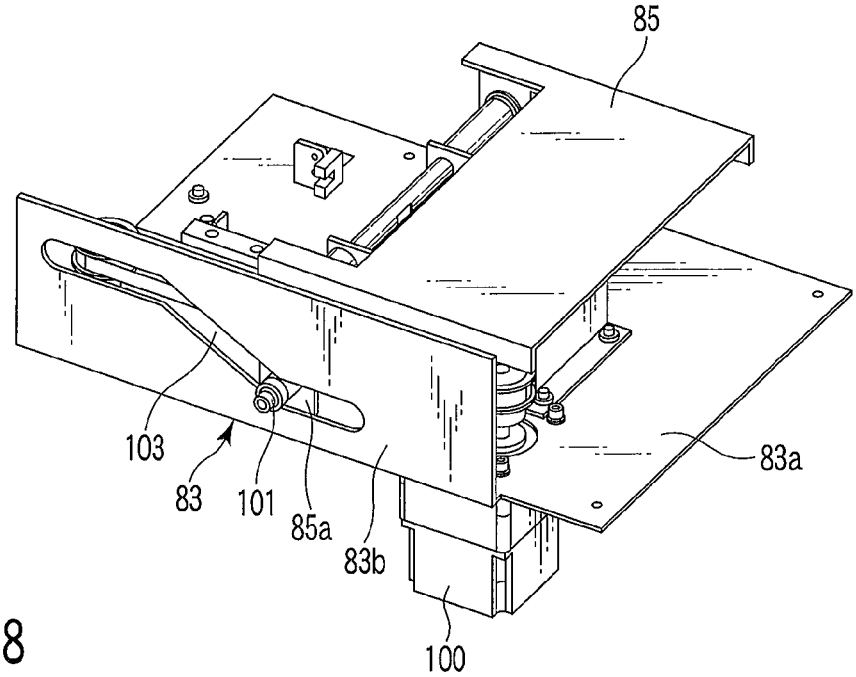
FIG. 18 is a perspective view showing the driving system for the standing tray in FIG. 17 as viewed from a different direction.

A timing belt 96 is provided on the board 83*a* of the support frame 83 and is coupled to the holding bracket 89 to move the holding bracket 89 along the slide rail 91. The timing belt 96 is placed between a driving pulley 97 and a driven pulley 98. The driving motor 100 is provided on a back surface of the board 83*a* of the support frame 83 to rotate the timing belt 96 forward and backward via the driving pulley 97 as shown in FIG. 18. Rotating the timing belt 96 moves the standing tray 85 along the slide rail 91.

Figure 19:
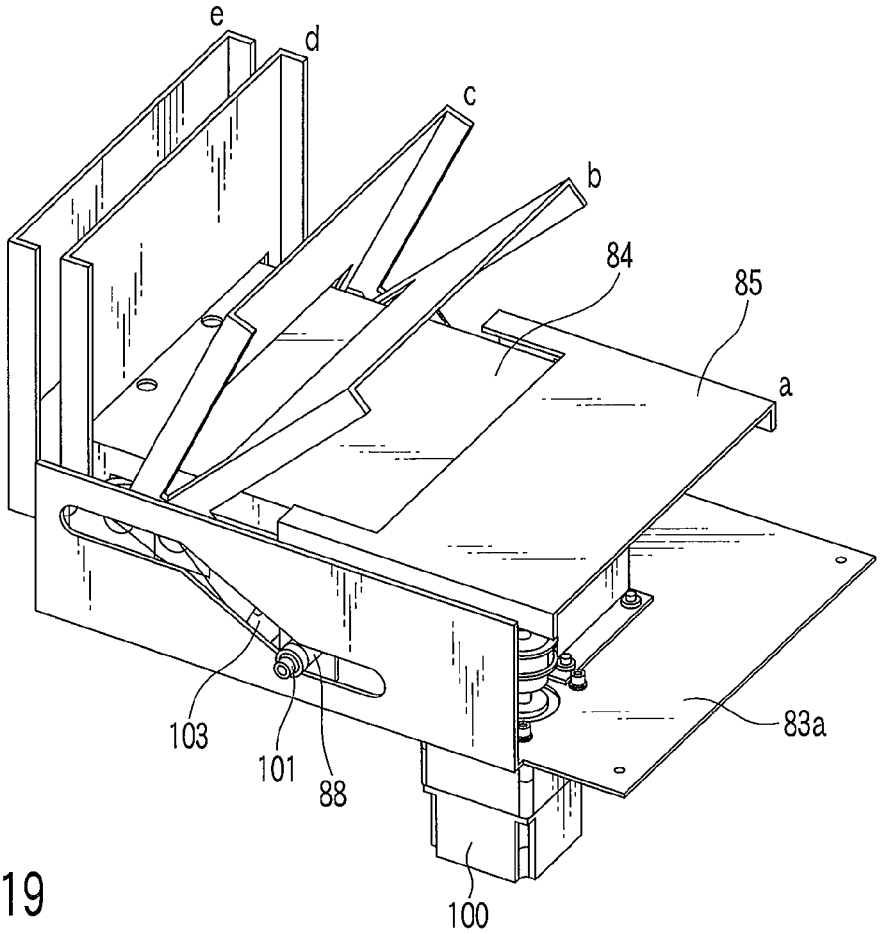
FIG. 19 is a perspective view showing how the standing tray in FIG. 16 is caused to pivot and stood upright.

A cam follower 101 is attached to one of the leg portions of the standing tray 85, that is, the leg portion 85*a*. The cam follower 101 is slidably fitted into a cam hole 101 formed in the folded portion 83*b* of the support frame 83. When the cam follower 101 moves along the cam hole 103 in conjunction with movement of the standing tray 85, the standing tray 85 pivots around the shaft 88 as shown in FIG. 19. That is, at a position where the standing tray 85 stands parallel to a table 84 as shown at a in FIG. 19, the standing tray 85 receives the bunch of sealed five bundles fed out by the rotating tray 66, corresponding to the preceding step. At this time, the position sensor 93 is obstructed by the sensor dog 85*c* on the standing tray 85. When moving toward the position sensor 94, the standing tray 85 is caused to pivot through positions b, c, and d in this order. The bunch of sealed five bundles is correspondingly caused to pivot through 90° so as to stand upright. The standing tray 85 further moves to a position e where the sensor dog 85*c* obstructs the position sensor 94. The upright bunch of sealed five bundles is pushed out onto the tray 22 in the chuter 21.

Now, description will be given of the bundle handling device 2 configured as described above.

Figure 20A:
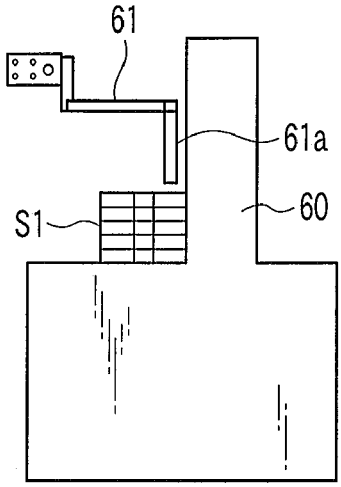
FIG. 20A is a diagram showing the operation of a transfer arm in FIG. 11.
Figure 20B:
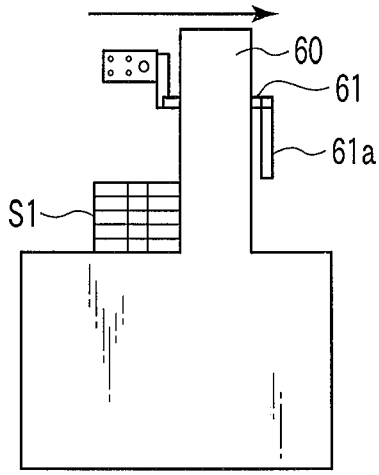
FIG. 20B is a diagram showing the operation of the transfer arm in FIG. 11.
Figure 20C:
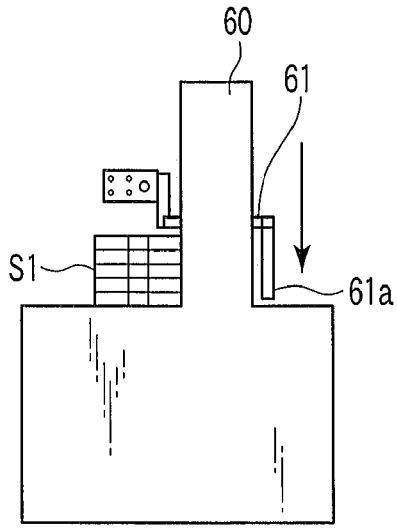
FIG. 20C is a diagram showing the operation of a transfer arm in FIG. 11.
Figure 21A:
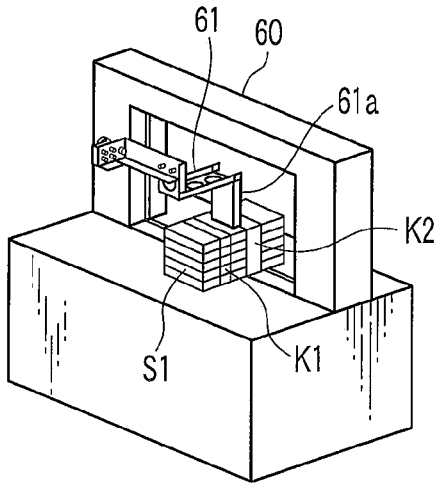
FIG. 21A is a diagram showing the operation of the transfer arm in FIG. 11.
Figure 21B:
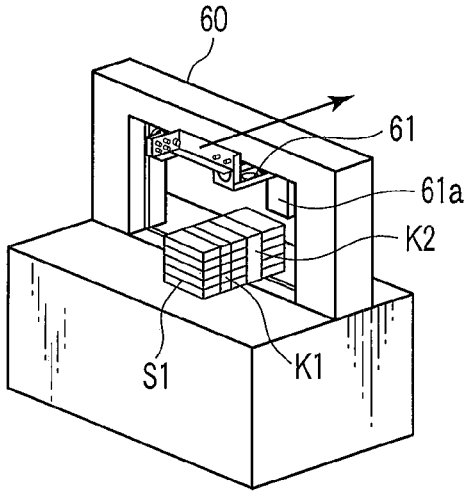
FIG. 21B is a diagram showing the operation of the transfer arm in FIG. 11.
Figure 21C:
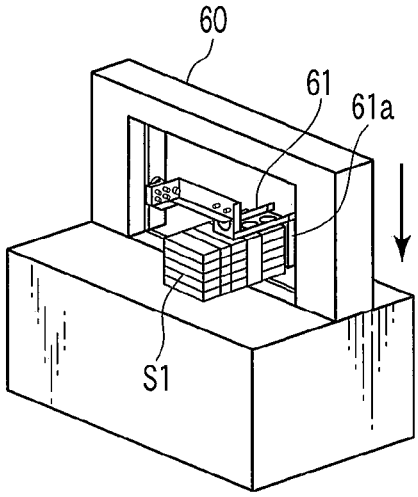
FIG. 21C is a diagram showing the operation of a transfer arm in FIG. 11.
Figure 22A:
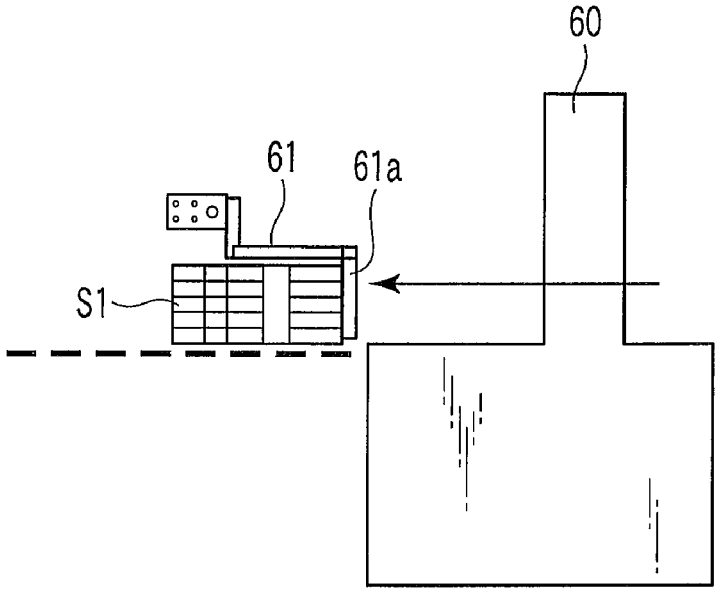
FIG. 22A is a diagram showing the operation of the transfer arm in FIG. 11.
Figure 22B:
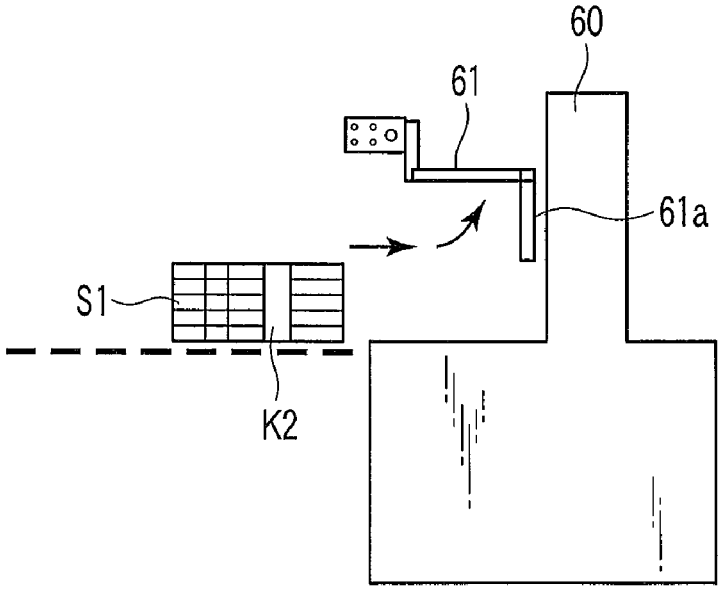
FIG. 22B is a diagram showing the operation of the transfer arm in FIG. 11.
Figure 23A:
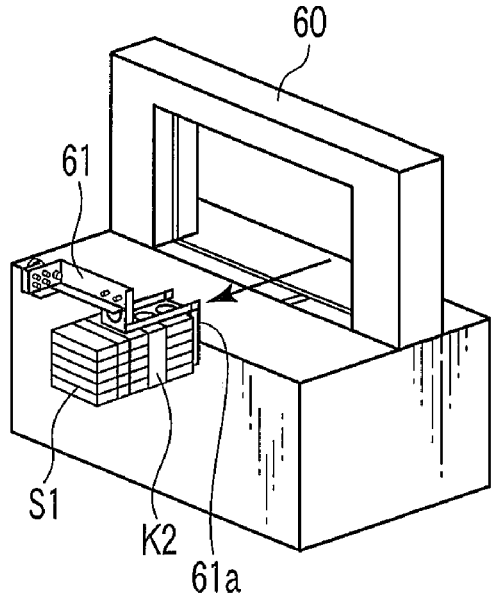
FIG. 23A is a diagram showing the operation of the transfer arm in FIG. 11.
Figure 23B:
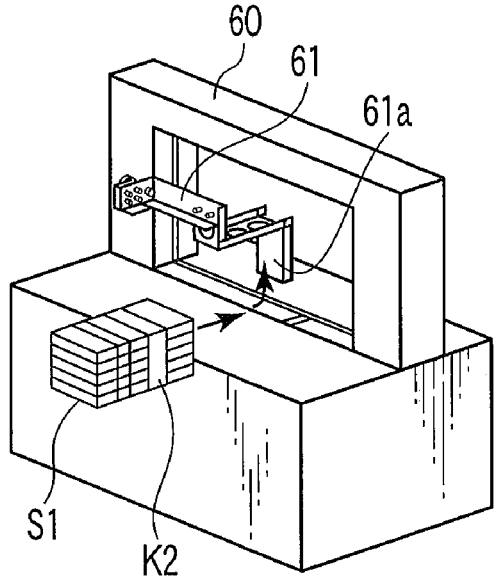
FIG. 23B is a diagram showing the operation of the transfer arm in FIG. 11.

First, as shown in FIGS. 20A and 21A, the banding machine 60 uses the large band K2 to bundle the (five) collected bundles transferred from the bundle collecting device 11 to form the bunch of sealed five bundles S1. After the bundling, the transfer arm 61 moves rightward as shown by an arrow in FIG. 20B and FIG. 21B and then downward as shown by an arrow in FIG. 20C and FIG. 21C to lower to a right end of the bunch of sealed five bundles S1. Subsequently, the transfer arm 61 moves leftward as shown by an arrow in FIG. 22A and FIG. 23A to hook the folded piece 61*a* on an end surface of the bunch of sealed five bundles S1. The transfer arm 61 then transfers the bunch of sealed five bundles S1 from the banding machine 60. After the transfer, the transfer arm 61 moves rightward and upward as shown in FIG. 22B and FIG. 23B to return to the standby position.

Figure 24A:
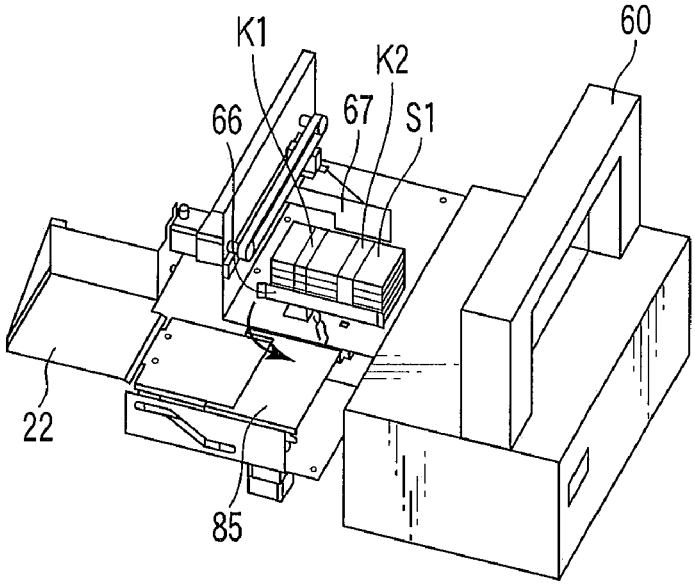
FIG. 24A is a diagram showing the operation of the direction changing mechanism in FIG. 12.
Figure 24B:
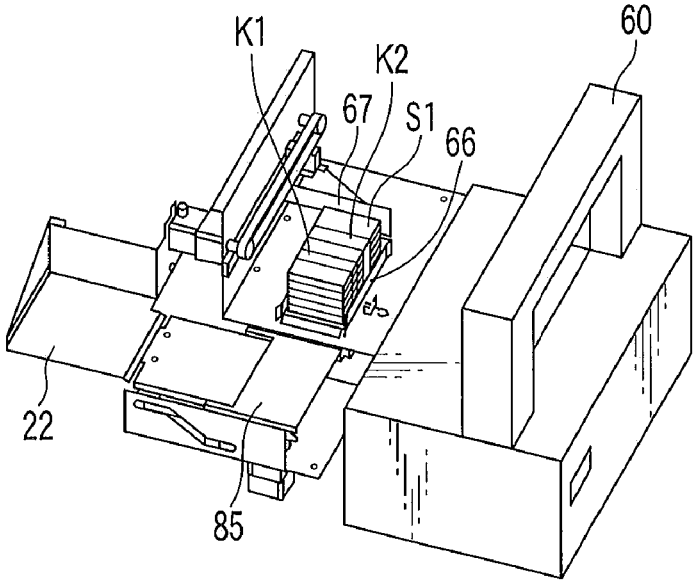
FIG. 24B is a diagram showing the operation of the direction changing mechanism in FIG. 12.
Figure 24C:
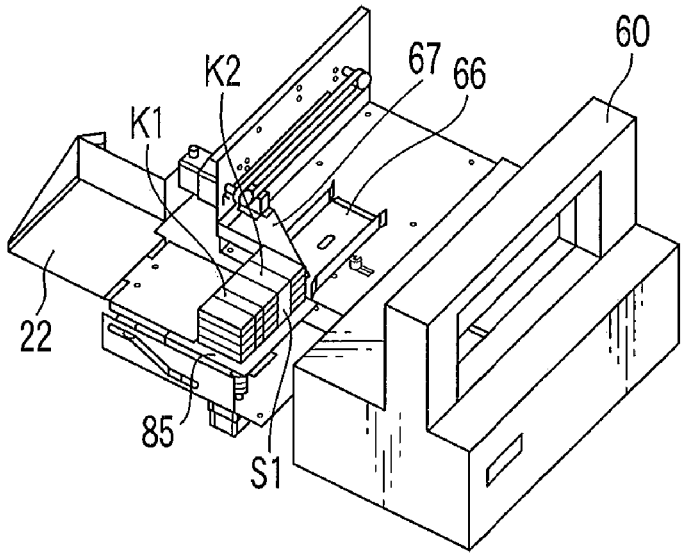
FIG. 24C is a diagram showing the operation of the direction changing mechanism in FIG. 12.
Figure 24D:
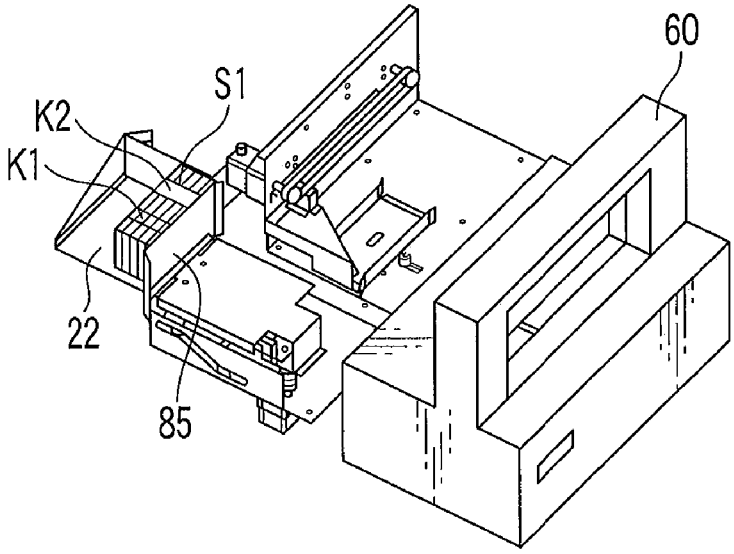
FIG. 24D is a diagram showing the operation of the direction changing mechanism in FIG. 12.

The bunch of sealed five bundles S1 moved by the transfer arm 61 is transferred onto the rotating tray 66 in the direction changing mechanism 64 as shown in FIG. 24A. After the transfer, the rotating tray 66 is rotated leftward (counterclockwise) through 90° as shown in FIG. 24B. After the rotation, the pusher 67 moves to feed out and transfer the bunch of sealed five bundles S1 from the rotating tray 66 onto the standing tray 85 as shown in FIG. 24C. After the transfer, as shown in FIG. 24D, the standing tray 85 is caused to pivot through 90° while being moved. The bunch of sealed five bundles is thus stood upright and transferred and placed on the tray 22 in the chuter 21.

Figure 25A:
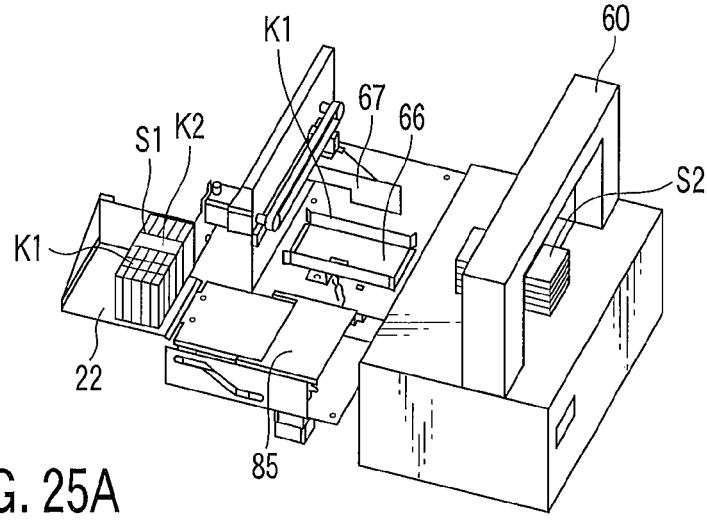
FIG. 25A is a diagram showing the operation of the direction changing mechanism in FIG. 12.
Figure 25B:
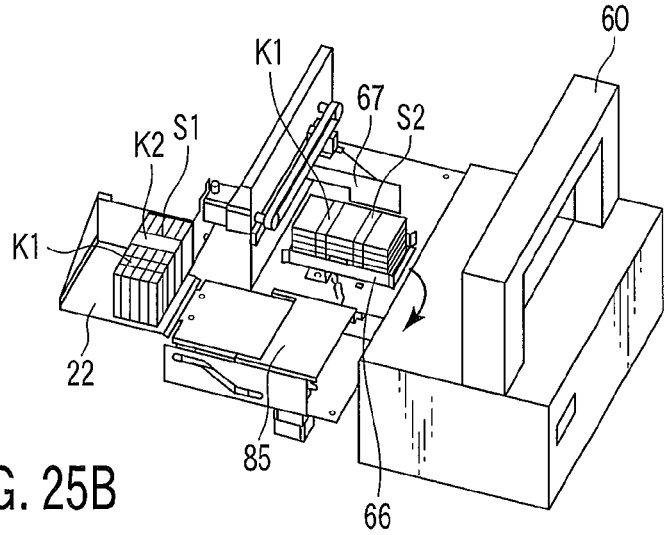
FIG. 25B is a diagram showing the operation of the direction changing mechanism in FIG. 12.
Figure 25C:
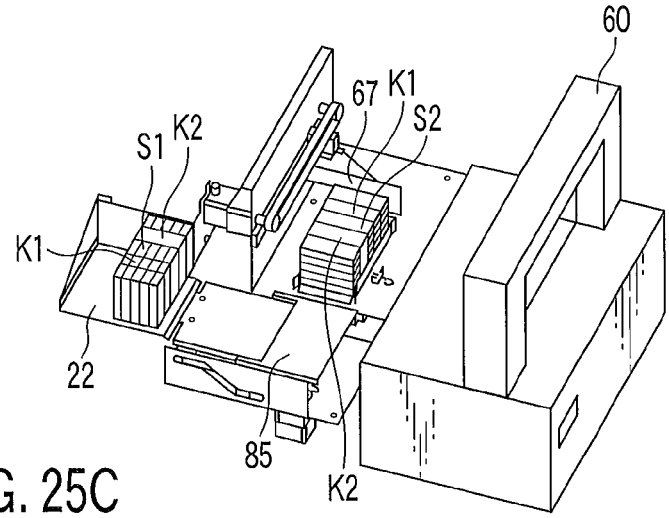
FIG. 25C is a diagram showing the operation of the direction changing mechanism in FIG. 12.
Figure 25D:
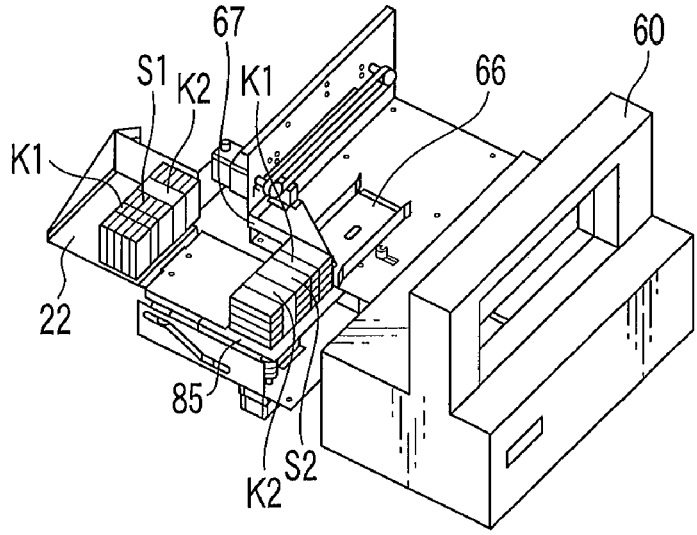
FIG. 25D is a diagram showing the operation of the direction changing mechanism in FIG. 12.
Figure 25E:
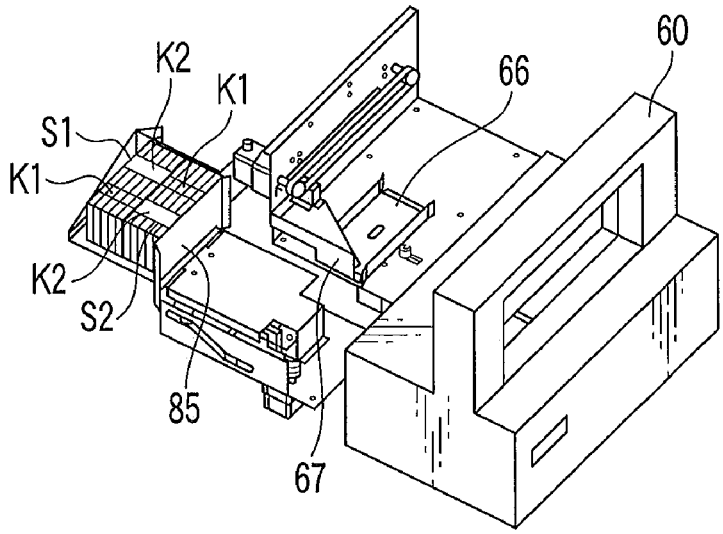
FIG. 25E is a diagram showing the operation of the direction changing mechanism in FIG. 12.

The first bunch of sealed five bundles is thus transferred and placed on the tray 22 in the chuter 21. Then, as shown in FIG. 25A, the rotating tray 66 is rotated through 90° to return to the initial position. At the same time, the standing tray 85 is caused to pivot through 90° while being moved in the opposite direction to return to the initial position. In this condition, the bundle collecting device 11 feeds the succeeding (five) collected bundles to the banding machine 60, which then places the large band K2 around the collected bundles to form a bunch of sealed five bundles S2. The second bunch of sealed five bundles S2 is transferred onto the rotating tray 66 as shown in FIG. 25B by means of the operation of the transfer arm 61 as described above. After the transfer, as shown in FIG. 25C, the rotating tray 66 is rotated rightward (clockwise) through 90° contrary to the case of the first bunch of sealed five bundles, described above. After the rotation, the pusher 67 is operated to move and transfer the bunch of sealed five bundles S2 from the rotating tray 66 onto the standing tray 85 as shown in FIG. 25D. After the transfer, the standing tray 85 is caused to pivot through 90° while being moved as shown in FIG. 25E. The bunch of sealed five bundles S2 is thus caused to pivot through 90° so as to stand upright and transferred and placed on the tray 22 in the chuter 21 so as to overlap the preceding bunch S1. At this time, the bunches of sealed five bundles S1 and S2 are laid on top of each other so that the positions of the small bands K1 on the bunches are staggered and so that the bunches face in the same direction.

That is, the bunches of sealed five bundles S1 and S2 on the rotating tray 66 are fed out by causing the bunches to pivot in the opposite directions. Thus, when the bunches of sealed five bundles S1 and S2 are laid on top of each other on the tray 22 in the chuter 21, the positions of the small bands K1 are staggered. Furthermore, since the standing tray 85 pivots to stand the bunches of the sealed five bundles S1 and S2 upright, when the bunches are laid on top of each other on the tray 22 in the chuter 21, the bunches face in the same direction.

The two bunches of sealed five bundles S1 and S2 laid on top of each other on the tray 22 in the chuter 21 are dropped onto the conveyor 3 when the tray 22 is pivotably tilted. The bunches of sealed five bundles S1 and S2 are conveyed to the lifter device 4, corresponding to the next step.

Now, the lifter device 4 will be described below in further detail.

Figure 26:
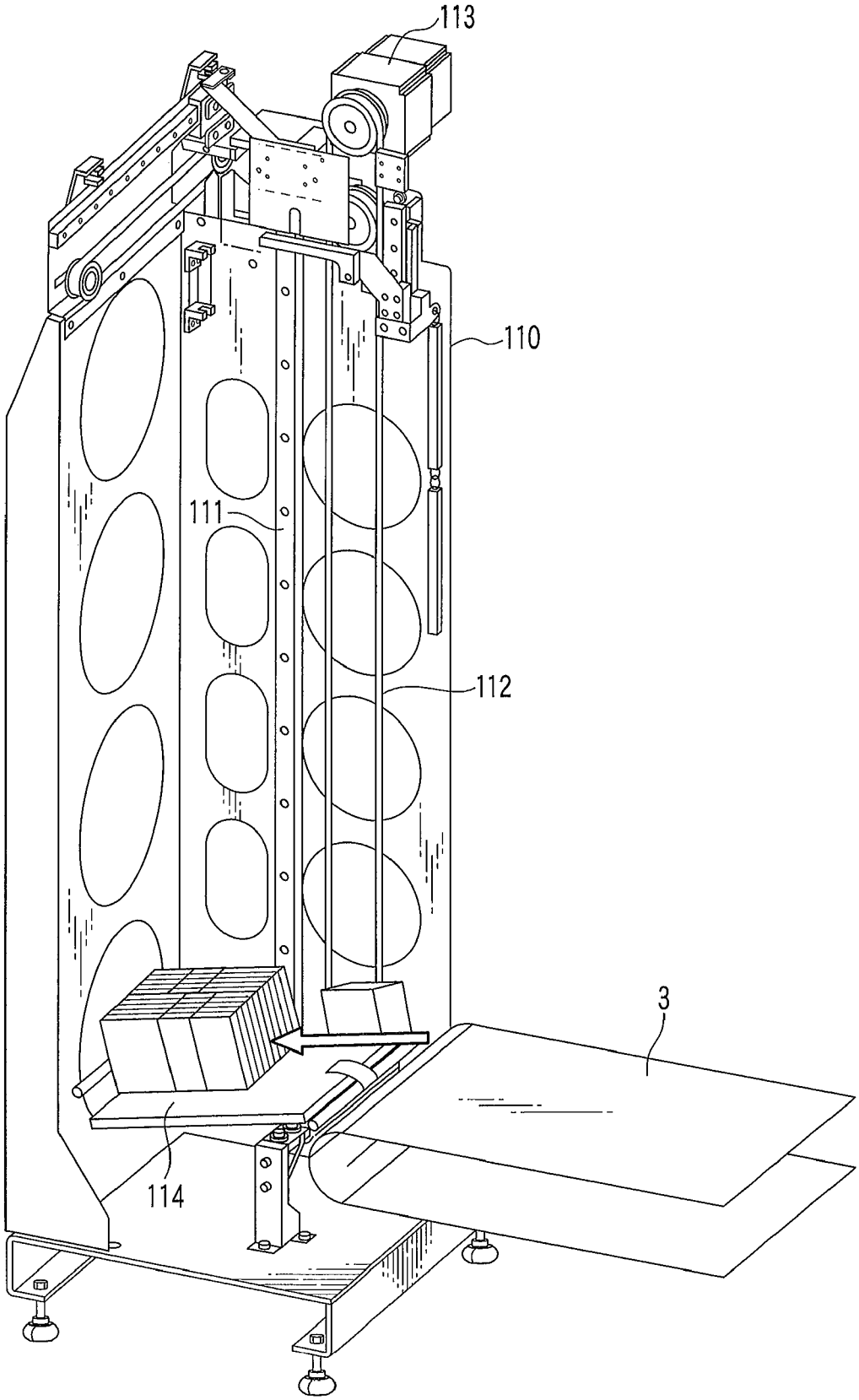
FIG. 26 is a perspective view showing the lifter device in FIG. 1.

As shown in FIG. 26, the lifter device 4 comprises a support frame 110 formed to have an L-shaped transverse section. A slide rail 111 and a driving belt 112 are arranged on the support frame 110 along the vertical direction. A driving motor 113 is provided at the top of the support frame 110 as a driving device that rotates the driving belt 112 forward and backward. A lifter tray 114 is provided in the support frame 110 and elevated and lower by means rotation of the driving belt 112.

Figure 27:
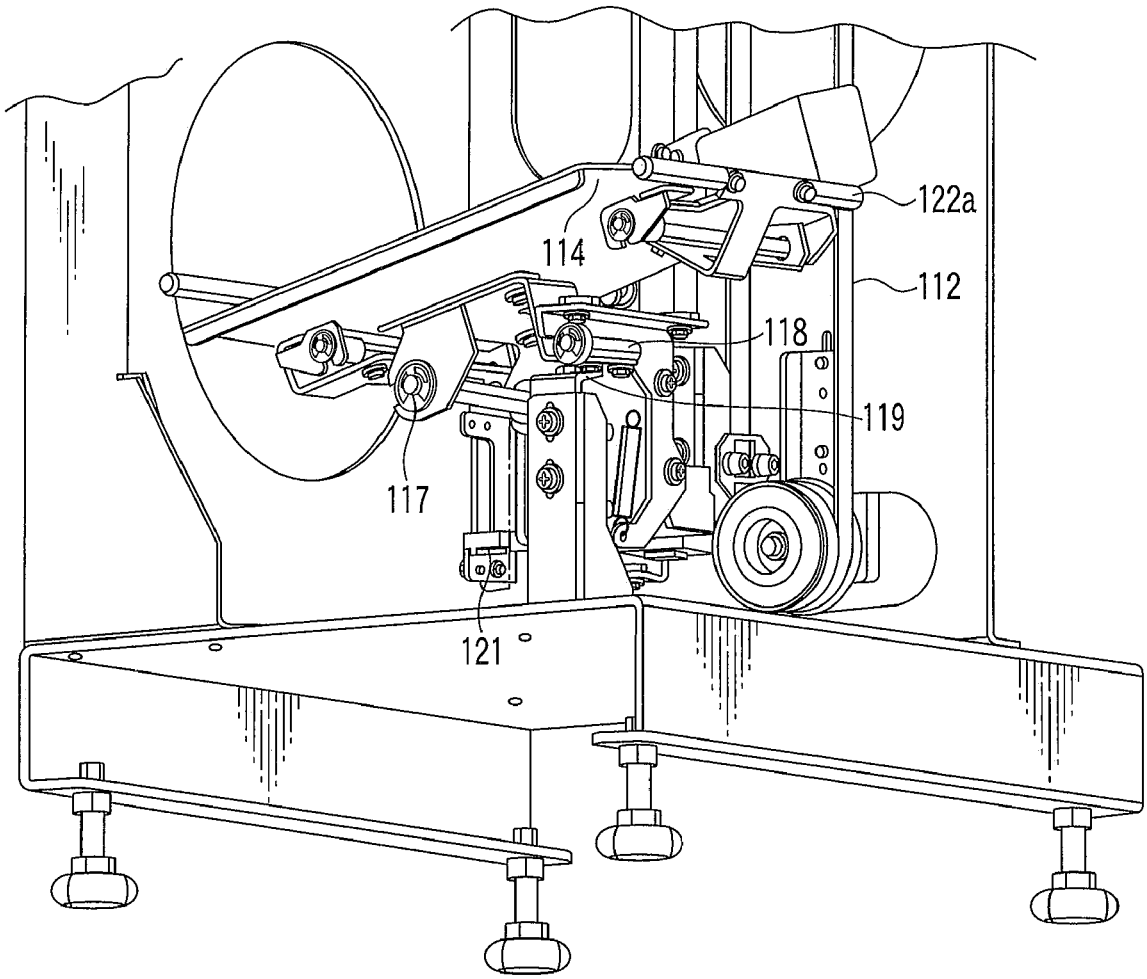
FIG. 27 is a perspective view showing the bottom of the lifter device in FIG. 1.
Figure 28:
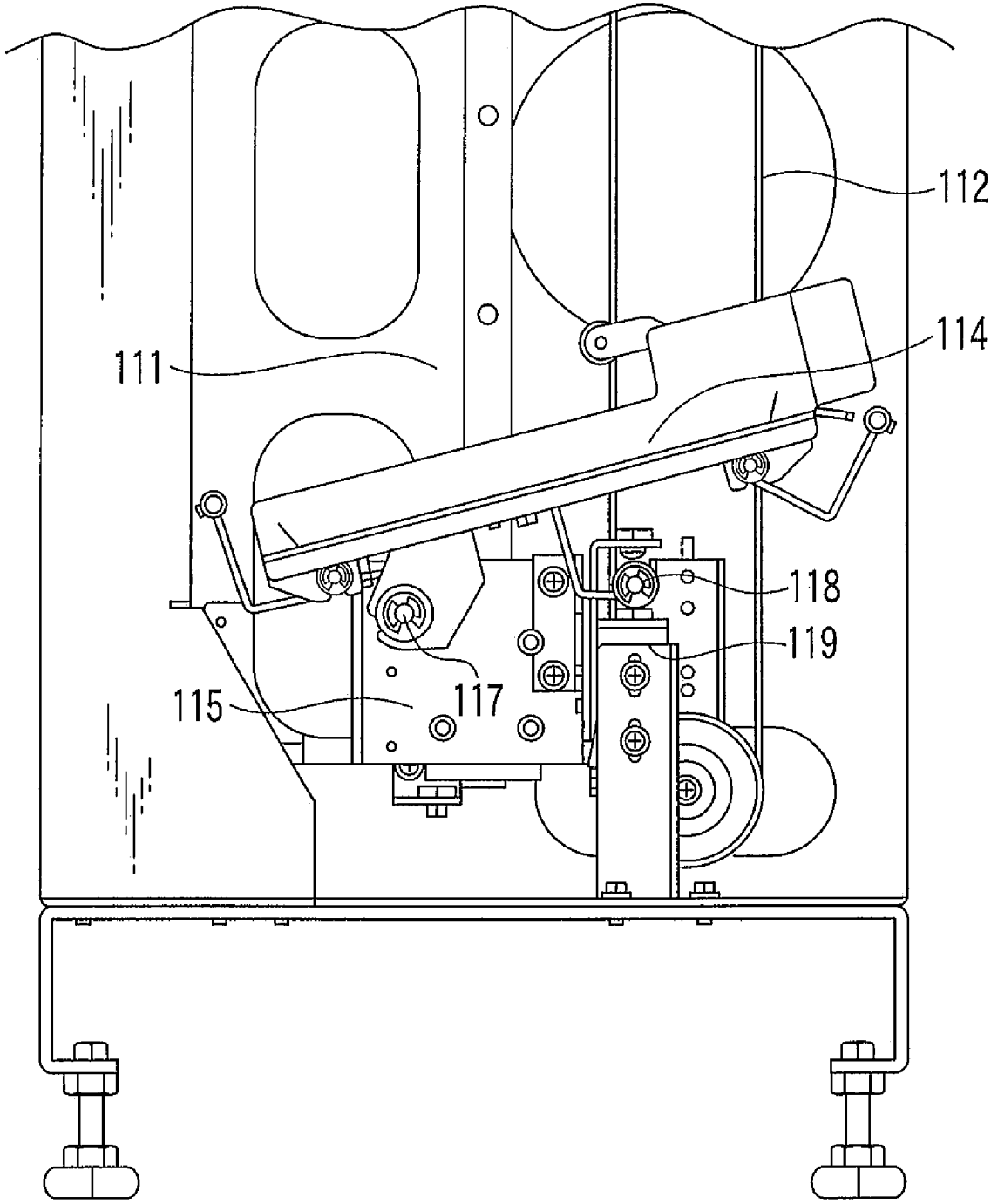
FIG. 28 is a front view of the lifter device in FIG. 27.

FIG. 27 is an enlarged perspective view showing the bottom of the lifter device 4. FIG. 28 is a front view of the bottom of the lifter device 4.

The lifter tray 114 receives the bunches of sealed five bundles S1 and S2 conveyed by the conveyor 3 and transfers the bunches upward. The lifter tray 114 is pivotably attached to a tray base 115 via a shaft 117. The tray base 115 is slidably held on the slide rail 111. A cam follower 118 is provided below the lifter tray 114. A stopper 119 is installed on an inner bottom surface of the support frame 110. When the lifter tray 114 lowers to the lowest end position, a cam follower 118 on the lifter tray 114 abuts against the stopper 119 to rotate the lifter tray 114 around a shaft 117 serving as a support point. This rotation tilts the lifter tray 114 beyond the horizontal so as to easily receive the two bunches of sealed five bundles loaded via the conveyor 3.

A position sensor 121 is provided below the support frame 110 to sense, when obstructed by a sensor dog on the tray base 115, that the lifter tray 114 is positioned at the lowest end. When the position sensor 121 senses that the lifter tray 114 is positioned at the lowest end, the driving motor 113 stops the driving operation and thus the lowering of the lifter tray 114.

Figure 29:
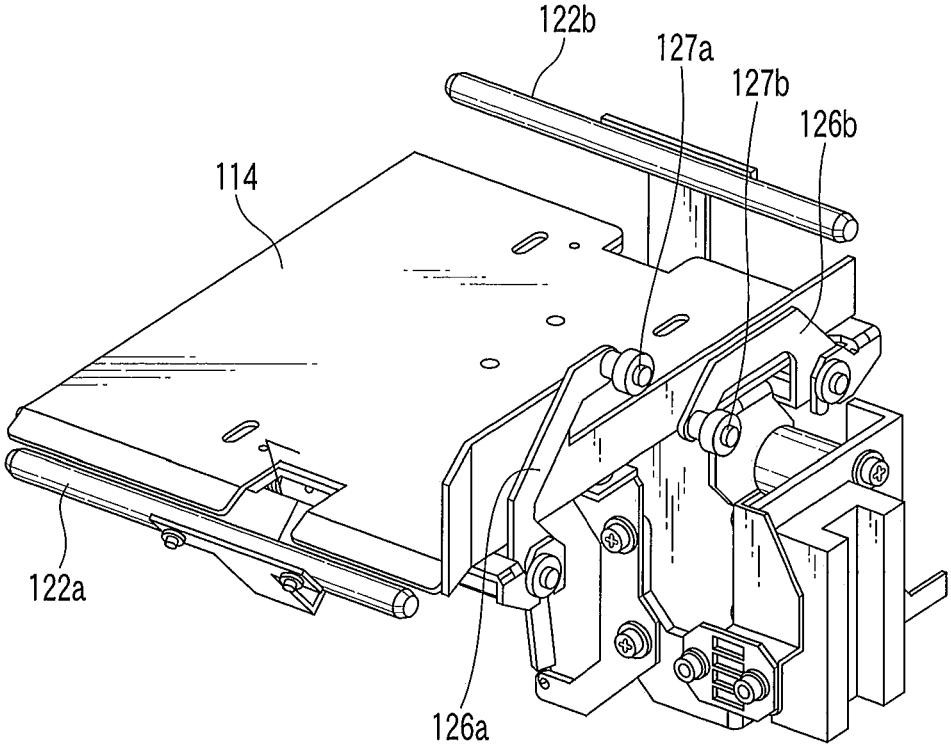
FIG. 29 is a perspective view showing a lifter tray in FIG. 27.
Figure 30:
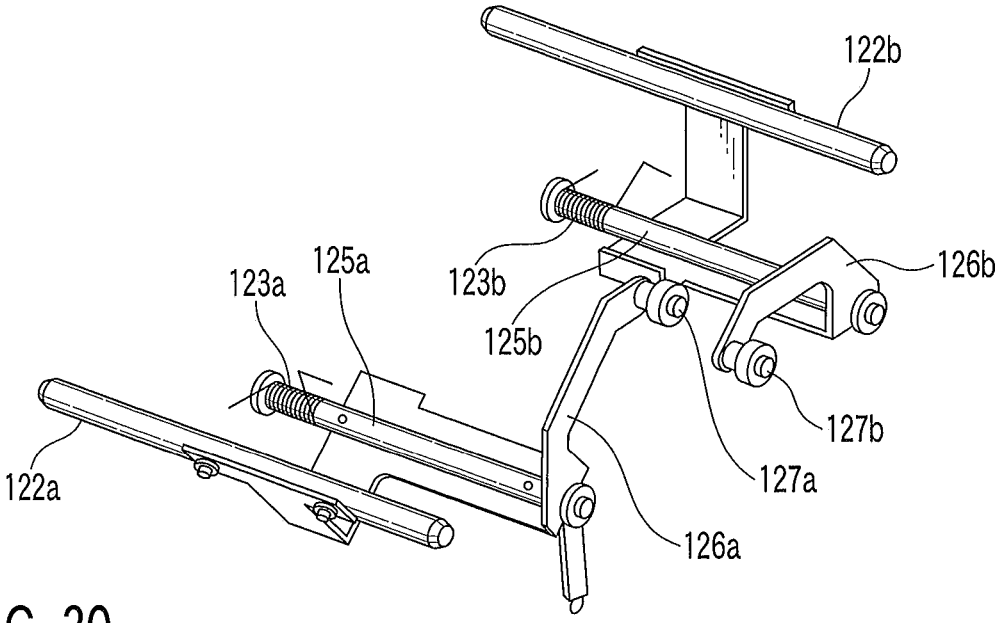
FIG. 30 is a perspective view showing aligning levers provided on the lifter tray in FIG. 29.

Aligning levers 122*a* and 122*b* as positioning devices are disposed on a side of the lifter tray 114 on which the bunch of sealed five bundles is received and on the opposite side, respectively, as also shown in FIGS. 29 and 30; the aligning levers 122*a* and 122*b* are pivotable via shafts 125*a* and 125*b*, respectively. The aligning levers 122*a* and 122*b* are biased by the bias force of alpha springs 123*a* and 123*b* in a direction in which the aligning levers 122*a* and 122*b* are opened with respect to each other; the aligning levers 122*a* and 122*b* are positioned so as not to interfere with the reception of the bunch of sealed five bundles. Base ends of the arms 126*a* and 126*b* are connected to the aligning levers 122*a* and 122*b*, respectively. Cam followers 127*a* and 127*b* are attached to leading ends of the arms 126 and 126*b*, respectively.

Figure 31:
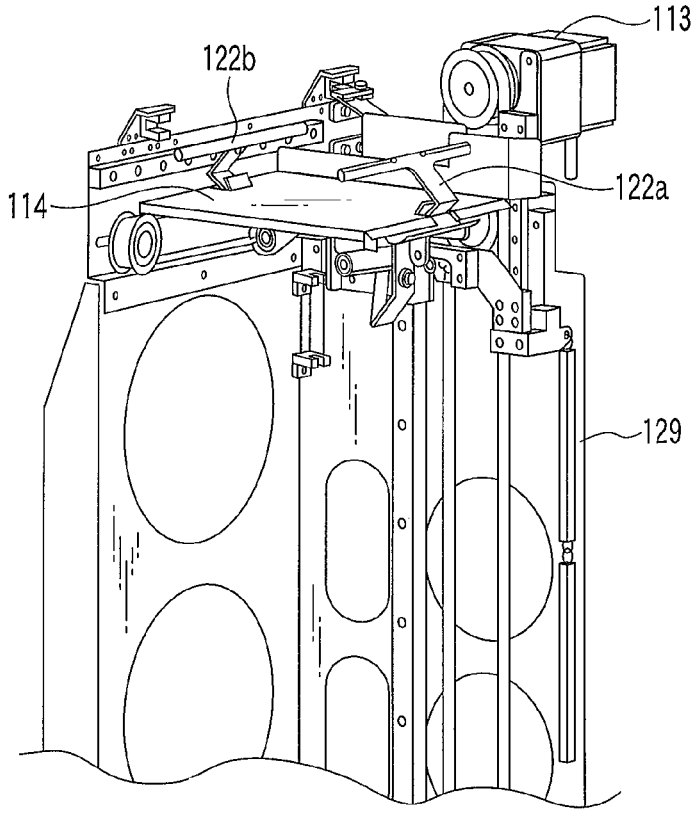
FIG. 31 is a diagram showing that the lifter tray in FIG. 27 has moved to an upper end of a support frame.

When the lifter tray 114 moves to the upper end as shown in FIG. 31, the cam followers 127*a* and 127*b* abut against an aligning block 130 described below and are pushed downward. The cam followers 127*a* and 127*b* are thus caused to pivot in a direction in which the aligning levers 122*a* and 122*b* are closed with respect to each other.

Figure 32:
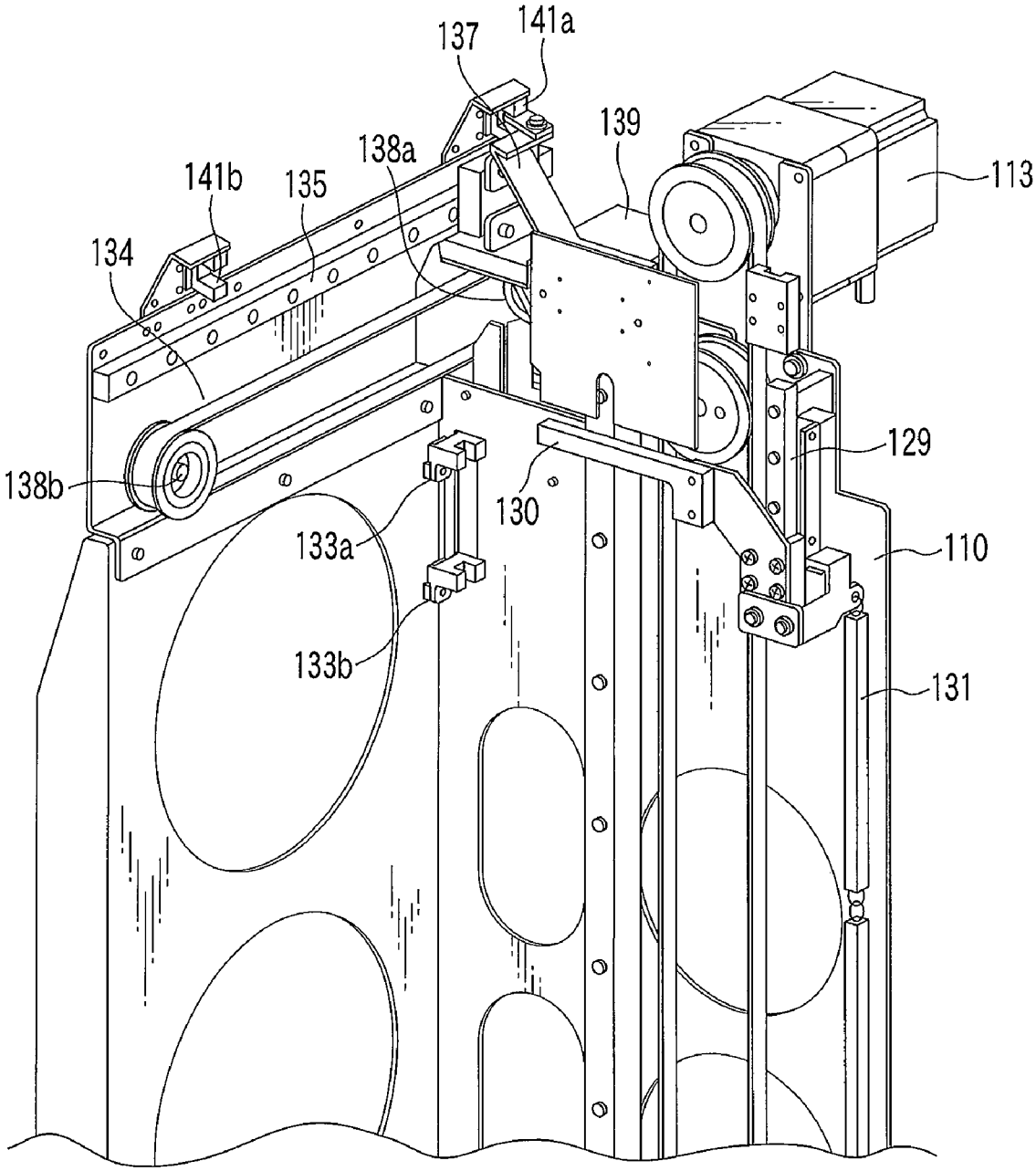
FIG. 32 is a perspective view showing the top of the lifter device.
Figure 34A:
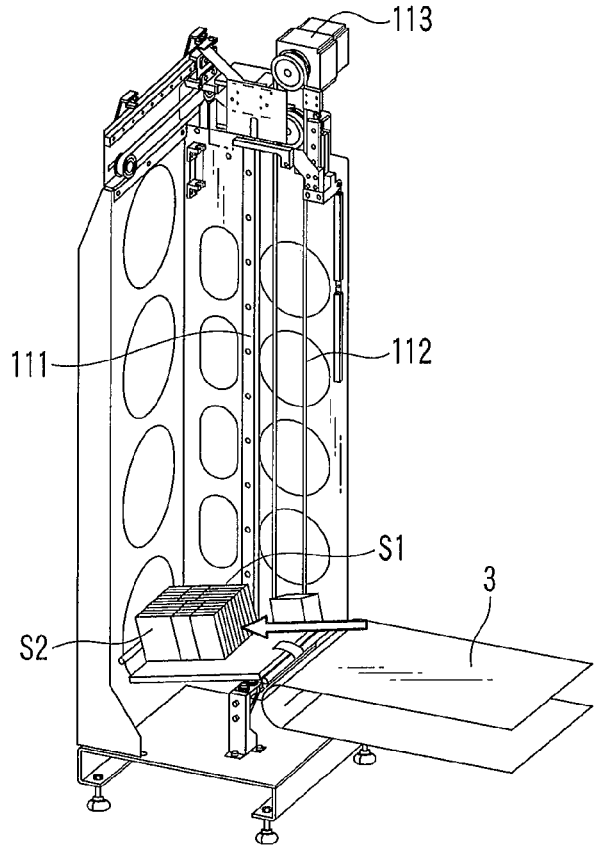
FIG. 34A is a diagram showing a lift operation of the lifter device in FIG. 26.
Figure 34B:
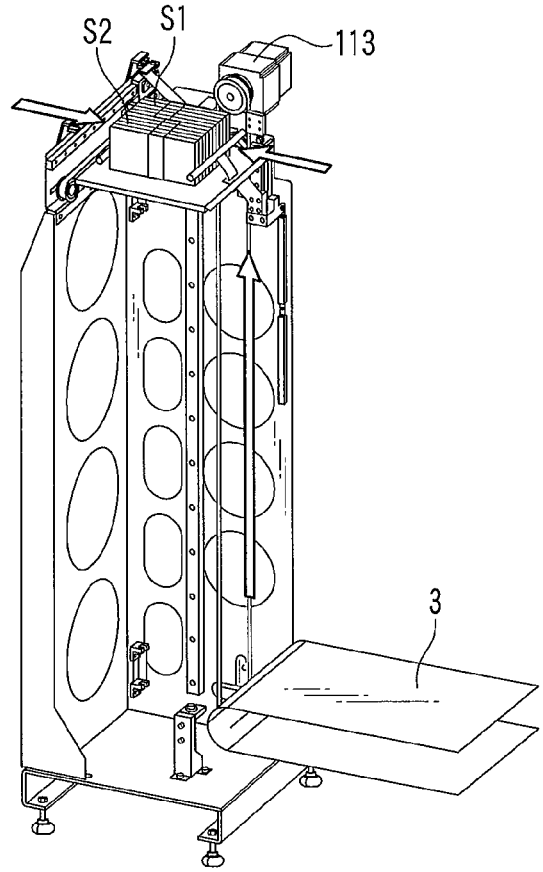
FIG. 34B is a diagram showing the lift operation of the lifter device in FIG. 26.
Figure 34C:
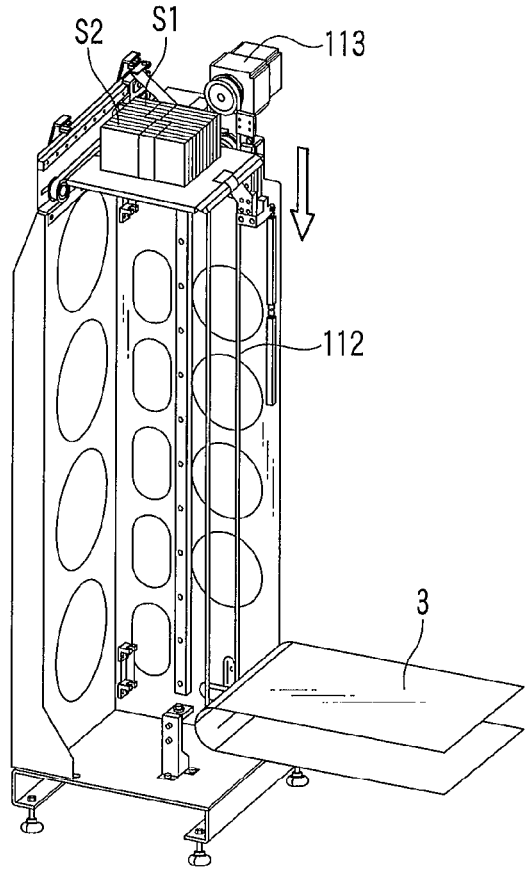
FIG. 34C is a diagram showing the lift operation of the lifter device in FIG. 26.
Figure 34D:
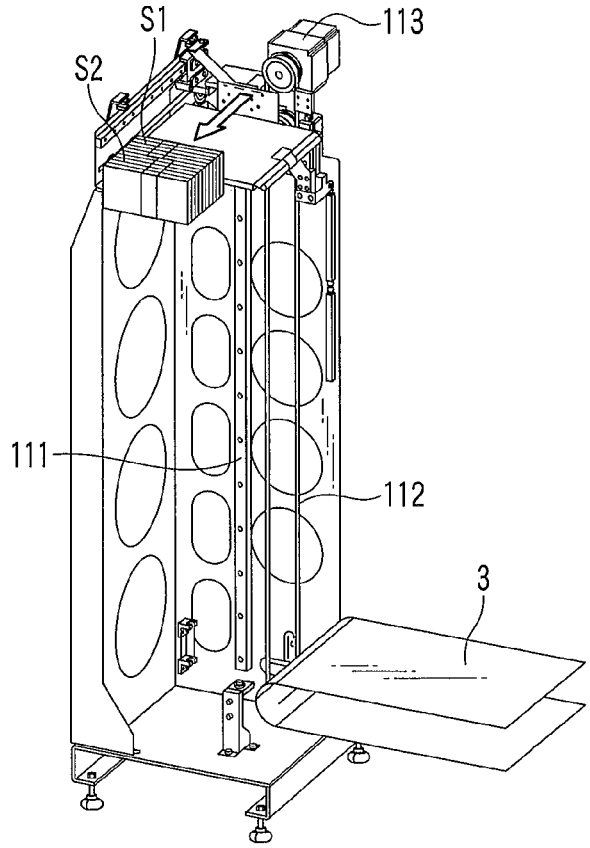
FIG. 34D is a diagram showing the lift operation of the lifter device in FIG. 26.

FIG. 32 shows the structure of the top of the lifter device 4.

A slide rail 129 is provided at the top of the support frame 100 along the vertical direction. An aligning block 130 is slidably attached to the slide rail 129. The aligning block 130 is biased downward by a spring 131 and held at a predetermined position. Position sensors 133*a* and 133*b* are disposed at the top of the support frame 110 and arranged in the vertical direction. The position 133*a* detects that the lifter tray 114 has reached the highest end position. The position sensor 133*b* senses that the lifter tray 114 has reached a position where the lifter tray 114 receives the bunches of sealed five bundles S1 and S2.

Figure 33:
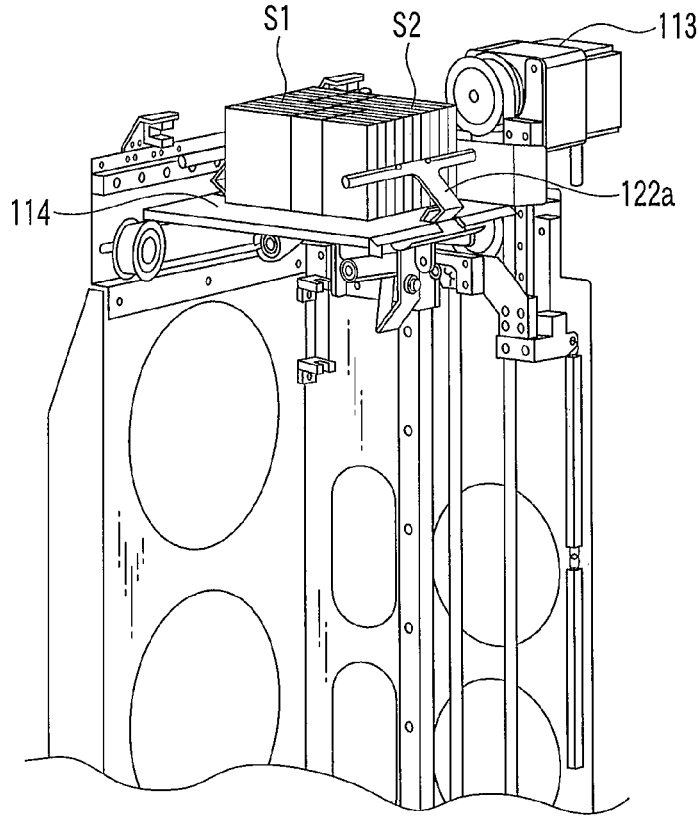
FIG. 33 is a diagram showing that the aligning levers in FIG. 31 have centered the two bunches of sealed five bundles.

When the lifter tray 114 is sensed by the position sensor 133*a*, the driving motor 113 is stopped to stop elevating the lifter tray 114. At this time, the cam followers 127*a* and 127*b* on the lifter tray 114 abut against the aligning block 130 and are pushed downward. The cam followers 127*a* and 127*b* are thus caused to pivot in the direction in which the aligning levers 122*a* and 122*b* are closed with respect to each other. As shown in FIG. 33, the two bunches of sealed five bundles S1 and S2 placed on the lifter tray 114 are moved in the longitudinal direction by the pivoting of the aligning levers 122*a* and 122*b*. The bunches are thus sandwiched and held between the aligning levers 122*a* and 122*b*. The center of bunches of sealed five bundles S1 and S2 aligns with the center of the tunnel-like shrink film 51 in the packing device 5, corresponding to the next step.

After the bunches of sealed five bundles S1 and S2 are positioned, the driving motor 113 is reversely rotated to lower the lifter tray 114. When the lowering allows the lifter tray 114 to reach the reception position, the driving motor 113 stops the driving operation to stop the lifter tray 114. At this time, the aligning block 130 is caused to stop pushing down the cam followers 127*a* and 127*b*. The aligning levers 122*a* and 122*b* are thus opened with respect to each other by the bias force of the alpha springs 123*a* and 123*b*.

On the other hand, a timing belt 134 and a slide rail 135 are provided at the top of the support frame 110 so as to extend parallel to each other along the horizontal direction. A pusher 137 is coupled to the timing belt 134. The timing belt 134 is placed between a driving pulley 138*a* and a driven belt 138*b*. A driving motor 139 is connected to the driving pulley 138*a*. The driving motor 139 rotates forward and backward to move the pusher 137 forward and backward via the timing belt 134.

A position sensor 141*a* is provided at one end of the slide rail 135 to sense that the pusher 137 has reached a standby position. A position sensor 141*b* is provided at the other end of the slide rail 135 to sense that the pusher 137 has reached a position where the pusher 137 feeds out the bunches of sealed five bundles S1 and S2.

On the basis of sensing of the pusher 137 by the position sensors 141*a* and 141*b*, the rotation of the driving motor 141 is stopped to stop the movement of the pusher 137.

Now, the operation of the lifter device 4 will be described.

First, as shown in FIG. 34(*a*), the lifter tray 114 is located at the reception position at the lower end of the support frame 110 to receive the bunches of sealed five bundles S1 and S2 conveyed on the conveyor 3. After the reception, as shown in FIG. 34(*b*), the lifter tray 114 is elevated. When the lifter tray 114 moves to the upper end, the cam followers 127*a* and 127*b* of the aligning levers 122*a* and 122*b* abut against the aligning block 130. The aligning levers 122*a* and 122*b* are thus caused to pivot in the direction in which the aligning levers 122*a* and 122*b* are closed with respect to each other. In this condition, when the lifter tray 114 is further elevated, the aligning block 130 is pushed upward against the bias force of the spring 131. The aligning levers 122*a* and 122*b* are thus caused to pivot further to move the bunches of sealed five bundles S1 and S2 along the longitudinal direction; the bunches of sealed five bundles S1 and S2 are thus sandwiched and held between the aligning levers 122*a* and 122*b*. The center of the bunches is aligned with the center of the tunnel-like shrink film 51 in the packing device 5, which corresponds to the next step.

After the bunches of sealed five bundles S1 and S2 are thus positioned, the lifter tray 114 is lowered by a predetermined amount to the reception position as shown in FIG. 34(*c*). Thus, the cam followers 127*a* and 127*b* of the aligning levers 122*a* and 122*b* are separated from the aligning block 130. The separation causes the aligning levers 122*a* and 122*b* to pivot, under the bias force of the alpha springs 123*a* and 123*b*, in the direction in which the aligning levers 122*a* and 122*b* are opened with respect to each other. After the separation, as shown in FIG. 34(*d*), the pusher 137 moves to push out the bunches of sealed five bundles S1 and S2 from the lifter tray 114 to deliver the bunches to the packing device 5, which corresponds to the next step. The packing device 5 then packs the bunches of sealed five bundles S1 and S2 as described above.

As described above, the present embodiment lays the bunches of sealed five bundles S1 and S2 on top of each other so that the small bands K1 around the bunches are staggered.

This makes it possible to make the thickness of the bunches uniform and to allow the bundles to be counted by 5's, facilitating the counting operation.

Furthermore, the bunches of sealed five bundles S1 and S2 can be laid on top of each other such that the bunches S1 and S2 face in the same direction. This eliminates the need for a separate operation of allowing the bunches to face in the same direction.

Moreover, on the lifter tray 114, the longitudinal center of the bunches of sealed five bundles S1 and S2 is aligned with the center of the tunnel-like shrink film 51 in the packing device 5. Thus, the bunches of sealed five bundles S1 and S2 can be inserted into the central part of the tunnel-like shrink film 51. This makes it possible to improve the finish state of the bunches packed by thermally shrinking the tunnel-like shrink film 51.

Furthermore, the aligning levers 122*a* and 122*b* are caused to pivot against the bias force of the spring 131. Consequently, even if the bunches of sealed five bundles placed on the lifter tray 114 have different sizes, the difference is absorbed by the spring 131 to allow the bunches to be positioned. This enables bunches of various sizes to be positioned.

Furthermore, the single driving motor 113 can be used to perform both the driving operation for elevating and lowering the lifter tray 114 and the driving operation for causing the aligning levers 122*a* and 122*b* to pivot. This enables a reduction in costs.

The present invention is not limited to the above-described embodiments proper. In implementation, the present invention can be embodied with the components of the embodiments varied without departing from the spirit of the present invention. Furthermore, various inventions can be formed by appropriately combining a plurality of the components disclosed in the above-described embodiments. For example, some of the components shown in the above-described embodiments may be removed. Moreover, components of different embodiments may be appropriately combined together.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A sheet processing system comprising:

a sheet processor which takes out and conveys sheets one by one from a supply section to which the sheets are collectively supplied, the sheet processor determining whether each of the sheets is real or false and whether the sheet is normal or damaged, executing a sorting process on the sheet on the basis of the determination, and every time the number of sheets subjected to the sorting process reaches a predetermined value, bundling the sheets using a first bundling band to form a bundle and then discharging the bundle;

a bundle collecting device which collects a predetermined number of bundles discharged by the sheet processor and feeds out the bundles as first collected bundles and which then collects again a predetermined number of bundles discharged by the sheet processor and feeds out the bundles as second collected bundles;

a bunch processor comprising a bunch forming device which uses a second bundling band different from the first bundling band to bundle the first colleted bundles fed out by the bundle collecting device and then feeds out the bundled bundles as a first bunch, the bunch processor then using the second bundling band different from the first bundling band to bundle the second colleted bundles fed out by the bundle collecting device and feeds out the bundled bundles as a second bunch, and a bunch laying device which lays the first and second bunches fed out by the bunch forming device, on top of each other so that the first bundling bands around the bunches are staggered and feeds out the bunches laid on top of each other;

a conveying device which receives and conveys the first and second bunches fed out by the bunch processor, on a conveying path;

a transfer device which receives the first and second bunches conveyed by the conveying device and transfers and feeds out the first and second bunches to a predetermined position; and a packing device which packs the first and second bunches fed out by the transfer device.

2. The sheet processing system according to claim 1, wherein a plurality of the sheet processors, a plurality of the bundle collecting devices, and a plurality of the bunch processors are disposed.

3. The sheet processing system according to claim 1, wherein the bundle processor has chuters provided on a top surface of the conveying path and separated from each other by a distance appropriate to allow the first and second bunches to pass through, the first and second bunches are placed on the chuters, and the chuters are pivotably tilted to feed out the first and second bunches.

4. The sheet processing system according to claim 3, wherein a bunch sensor is provided upstream of the chuters in a bunch conveying direction to sense the bunches, and the chuters are caused to pivot on the basis of the bunch sensor continuously failing to sense a bunch on the conveying path for a predetermined time.

5. A sheet processing system comprising:

a sheet processor which takes out and conveys sheets one by one from a supply section to which the sheets are collectively supplied, the sheet processor determining whether each of the sheets is real or false and whether the sheet is normal or damaged, executing a sorting process on the sheet on the basis of the determination, and every time the number of sheets subjected to the sorting process reaches a predetermined value, bundling the sheets using a first bundling band to form a bundle and then discharging the bundle;

a bundle collecting device which collects a predetermined number of bundles discharged by the sheet processor and feeds out the bundles as first collected bundles and which then collects again a predetermined number of bundles discharged by the sheet processor and feeds out the bundles as second collected bundles;

a bunch processor comprising a bunch forming device which uses a second bundling band different from the first bundling band to bundle the first colleted bundles fed out by the bundle collecting device and then feeds out the bundled bundles as a first bunch, the bunch forming device then using the second bundling band different from the first bundling band to bundle the second colleted bundles fed out by the bundle collecting device and feeds out the bundled bundles as a second bunch, and a bunch laying device which lays the first and second bunches fed out by the bunch forming device on top of each other so that the first bundling bands around the first and second bunches are staggered and which then feeds out the first and second bunches laid on top of each other;

a conveying device which receives and conveys the first and second bunches fed out by the bunch processor, on a conveying path;

a lifter device which uses a lifter tray to receive the first and second bunches conveyed by the conveying device, elevates the lifter tray to transfer the first and second bunches to a predetermined position, and then feeds out the first and second bunches;

a packing device which packs the first and second bunches fed out by the lifter device; and a positioning device which positions the first and second bunches on the lifter tray so that a center of the first and second bunches aligns with a center of the packing device.

6. The sheet processing system according to claim 5, wherein the positioning device comprises a pair of pivotable aligning levers, and causes the pair of aligning levers to pivot to sandwich and hold opposite ends of the first and second bunches located along a feed-out direction between the aligning levers for positioning.

7. The sheet processing system according to claim 6, wherein the lifter tray and the aligning levers are driven by a single driving device.

8. A sheet processing system comprising:

a sheet processor which takes out and conveys sheets one by one from a supply section to which the sheets are collectively supplied, the sheet processor determining whether each of the sheets is real or false and whether the sheet is normal or damaged, executing a sorting process on the sheet on the basis of the determination, and every time the number of sheets subjected to the sorting process reaches a predetermined value, bundling the sheets using a first bundling band to form a bundle and then discharging the bundle;

a bundle collecting device which collects a predetermined number of bundles discharged by the sheet processor and feeds out the bundles as first collected bundles and which then collects again a predetermined number of bundles discharged by the sheet processor and feeds out the bundles as second collected bundles;

a bunch processor comprising a bunch forming device which uses a second bundling band different from the first bundling band to bundle the first colleted bundles fed out by the bundle collecting device and then feeds out the bundled bundles as a first bunch, the bunch forming device then using the second bundling band different from the first bundling band to bundle the second colleted bundles fed out by the bundle collecting device and feeds out the bundled bundles as a second bunch, a direction changing device which receives, at a reception position, the first bunch fed out by the bunch forming device, and causes the first bunch to pivot through a predetermined angle in a first direction to feed out the first bunch, the direction changing device then returning to the reception position to receive the second bunch fed out by the bunch forming device and causing the second bunch to pivot through the predetermined angle in a second direction opposite to the first direction to feed out the second bunch, a standing device which receives the first bunch fed out by the direction changing device, causes the first bunch to pivot so that the first bunch stands upright, and then feeds out the first bunch, the standing device then receiving the second bunch fed out by the direction changing device, causing the second bunch to pivot so that the second bunch stands upright, and then feeding out the second bunch to lay the second bunch on top of the first bunch, and a feed-out device which feeds out the first and second bunches stood upright and laid on top of each other;

a conveying device which receives and conveys the first and second bunches fed out by the bunch processor, on a conveying path;

a transfer device which receives the first and second bunches conveyed by the conveying device and transfers and feeds out the first and second bunches to a predetermined position; and a packing device which packs the first and second bunches fed out by the transfer device.

9. The sheet processing system according to claim 8, wherein the direction changing device comprises a rotating tray which receives the first bunch or the second bunch and which pivots counterclockwise through a predetermined angle if the rotating tray receives the first bunch, the rotating tray pivoting clockwise through the predetermined angle if the rotating tray receives the second bunch, and a pusher which feeds out the first bunch or the second bunch caused to pivot by the rotating tray, from the rotating tray.

* * * * *